US007068244B2

(12) United States Patent
Nagao et al.

(10) Patent No.: US 7,068,244 B2
(45) Date of Patent: Jun. 27, 2006

(54) PLASMA DISPLAY PANEL DEVICE AND ITS DRIVE METHOD

(75) Inventors: Nobuaki Nagao, Katano (JP); Toru Ando, Osaka (JP); Masaki Nishimura, Takatuki (JP); Hidetaka Higashino, Souraku-gun (JP); Yuusuke Takada, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 461 days.

(21) Appl. No.: 10/398,606

(22) PCT Filed: Oct. 16, 2001

(86) PCT No.: PCT/JP01/09060

§ 371 (c)(1),
(2), (4) Date: Apr. 4, 2003

(87) PCT Pub. No.: WO02/33690

PCT Pub. Date: Apr. 25, 2002

(65) Prior Publication Data

US 2004/0095295 A1 May 20, 2004

(30) Foreign Application Priority Data

Oct. 16, 2000 (JP) ..... 2000-314853

(51) Int. Cl.
*G09G 3/28* (2006.01)

(52) U.S. Cl. ..... 345/60; 345/68; 315/169.4

(58) Field of Classification Search ..... 345/60, 345/61, 62, 64, 63, 66, 68, 80; 315/581, 315/169.3, 169.2, 169.4
See application file for complete search history.

(56) References Cited

U.S. PATENT DOCUMENTS

| | | | | |
|---|---|---|---|---|
| 5,640,068 | A | 6/1997 | Amemiya | |
| 6,429,834 | B1 * | 8/2002 | Kanazawa et al. | 345/63 |
| 6,707,436 | B1 * | 3/2004 | Setoguchi et al. | 345/60 |
| 6,803,888 | B1 * | 10/2004 | Nakamura et al. | 345/60 |
| 2001/0024921 | A1 | 9/2001 | Hirano | |

FOREIGN PATENT DOCUMENTS

| | | |
|---|---|---|
| JP | 8315735 | 11/1996 |

(Continued)

*Primary Examiner*—Amr A. Awad
*Assistant Examiner*—Abbas I. Abdulselam

(57) ABSTRACT

It is the object of the invention to provide a PDP apparatus and a driving method that can apply pulses at high speeds and can display high-definition, high-quality images by allowing discharge cells to emit light with high luminance and high efficiency.

To achieve the object, the pulse has (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion, and the second waveform portion starts before a discharge delay time elapses from a start of the first waveform portion.

Also to achieve the object, in a PDP having an electrode structure in which each electrode is divided into a plurality of line electrodes, the applied pulse has (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion.

50 Claims, 35 Drawing Sheets

FOREIGN PATENT DOCUMENTS

| | | |
|---|---|---|
| JP | 10149774 | 6/1998 |
| JP | 10321148 | 12/1998 |
| JP | 11282416 | 10/1999 |
| JP | P2000-148083 A | 5/2000 |
| WO | WO 00/14711 | 3/2000 |
| WO | WO 00/30065 | 5/2000 |

* cited by examiner

PLASMA DISPLAY PANEL DEVICE AND ITS DRIVE METHOD

TECHNICAL FIELD

The present invention relates to a plasma display panel apparatus that is used as the display screen for computers, televisions and the like, and a driving method thereof, and in particular to an AC plasma display panel.

BACKGROUND ART

Recently, plasma display panels (hereafter referred to as PDPs) have become the focus of attention for their ability to realize a large, slim and lightweight display apparatus for use in computers, televisions and the like.

PDPs can be broadly divided into two types: direct current (DC) and alternating current (AC). Of these, AC PDPs are at present the dominant type.

In a typical AC PDP, a front substrate and a back substrate are placed in parallel so as to face each other. A scanning electrode group and a sustain electrode group are formed in parallel strips on the inward-facing surface of the front substrate. The electrode groups are covered by a dielectric layer. A data electrode group is formed in parallel strips perpendicular to the scanning electrode group, on the inward-facing surface of the back substrate. The space between the front substrate and the back substrate is divided into smaller spaces by the stripe ribs. Discharge gas is sealed in these spaces. Discharge cells are formed in the space between the substrates, at the points where the scanning electrodes and the data electrodes intersect, the discharge cells as a whole thus forming a matrix.

When a PDP is activated, each discharge cell is turned on or off through a sequence of the periods: an initialization period in which all discharge cells are initialized by applying an initialization pulse; a write period in which pixel information is written by applying a data pulse to data electrodes selected from the data electrode group while sequentially applying a scanning pulse to the scanning electrodes; a discharge sustain period in which light is emitted by sustaining a main discharge by applying a rectangular-wave sustain pulse to a space between the scanning electrode group and the sustain electrode group; and an erase period in which wall charge of the discharge cells is erased.

Each discharge cell is fundamentally only capable of two display states, ON and OFF. Here, an in-field time division gray scale display method in which one frame (one field) is divided into a plurality of sub-fields and the ON and OFF states in each sub-field are combined to express a gray scale is used.

In such a PDP, it is a significant challenge to drive the PDP with a small amount of power consumption. To reduce the power consumption for driving PDP, it is desired to improve the luminous efficiency by reducing the amount of power consumption in the sustain period. The problem of the power consumption becomes more significant when wide transparent electrodes are used to improve the luminance in image display. This is because the wide transparent electrodes consume a lot of power.

To suppress the discharge current from increasing, some attempts have been made. One of such attempts is to reduce the area of electrode per discharge cell by making an opening in each transparent electrode or by dividing each electrode into a plurality of line electrodes. However, in this type of electrode, a voltage drop is apt to be caused at the electrode terminal, or when a drive pulse is applied, the discharge current is apt to separate into a plurality of peaks. When this happens, the light-emission luminance tends to greatly depend on the drive voltage.

When the gray scale is represented by the length of the sustain period (that is, by the number of sustain pulses), the discharge current in the whole panel varies as the number of turned-on discharge cells on the panel greatly changes depending on the image signal. However, when the light-emission luminance depends on the drive voltage greatly as described above, the effective drive voltage applied to the discharge cells varies. Accordingly, in such a case, it is difficult to control the gray scale. This is another problem.

On the other hand, the PDP, as well as other types of displays, is becoming to have higher definition. With this tendency, the length (that is, time period) of the write pulse is becoming shorter. For example, for displaying full-color moving pictures, the write pulse width in the write period is defined as no longer than 2.5 μs, and for the full-spec high-definition (highly minute with the number of scanning lines being 1080) the write pulse width is defined as 1–1.3 μs, which is very short.

Too short a time period of the write pulse causes a write defect, degrading the image quality. As a result, it is desired that to achieve a high-definition PDP, the DPD is driven at a high speed by reducing the write pulse to be shorter than the sustain pulse width, and allowing the PDP to emit light with high luminance.

When a simple rectangular wave is used as the sustain pulse, if the data pulse width is set to approximately 2 μs or shorter, the discharge probability at the sustain discharge decreases, and this is apt to cause the image quality degradation.

In such conditions, a technique for driving the sustain pulse at a high speed is also desired.

DISCLOSURE OF THE INVENTION

It is therefore the object of the present invention to provide a PDP apparatus and a driving method that can apply pulses at high speeds and can display high-definition, high-quality images by allowing discharge cells to emit light with high luminance and high efficiency.

The above object is fulfilled by a plasma display apparatus comprising: a plasma display panel including a pair of substrates between which a pair of electrodes are formed, a plurality of discharge cells being formed along the pair of electrodes; and a driving circuit that drives the plasma display panel by selectively writing information onto the plurality of discharge cells, then causing cells, on which the information is written, to emit light by applying a pulse to the pair of electrodes, wherein the pulse applied by the driving circuit has (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion, and the second waveform portion starts before a discharge delay time elapses from a start of the first waveform portion.

It should be noted here that the "discharge start voltage" is a minimum voltage for generating discharge that is observed when a rectangular pulse voltage is applied to the pair of electrodes, and the voltage is increased gradually.

Also, it is preferred that the above pulse has a third waveform portion where a third voltage, an absolute value of which is smaller than the absolute value of the second voltage, is applied, the third waveform portion following the second waveform portion.

With the use of such a pulse having the above characteristics, the discharge current at the discharge start is restricted, and a great amount of power is used by the discharge space when the discharge grows. This results in the improvement in the excitation efficiency of Xe and the luminous efficiency of the PDP. Also, since the discharge current peak ends within a short time period, such a pulse is suitable for a high-speed driving.

Also, in a PDP having an electrode structure in which each electrode is divided into a plurality of line electrodes, the applied pulse may have (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion. This construction also improves the luminous efficiency of the PDP, and achieves a high-speed driving. Also, the restriction of the voltage drop leads to achievement of a high-luminance, high-light-emission-efficiency, high-image-quality PDP.

It is also preferred in this case that the above pulse has a third waveform portion where a third voltage, an absolute value of which is smaller than the absolute value of the second voltage, is applied, the third waveform portion following the second waveform portion.

BEST MODE FOR CARRYING OUT THE INVENTION

EMBODIMENT 1

A plasma display apparatus (PDP display apparatus) includes, for example, a PDP and a driving circuit.

Figure 1:
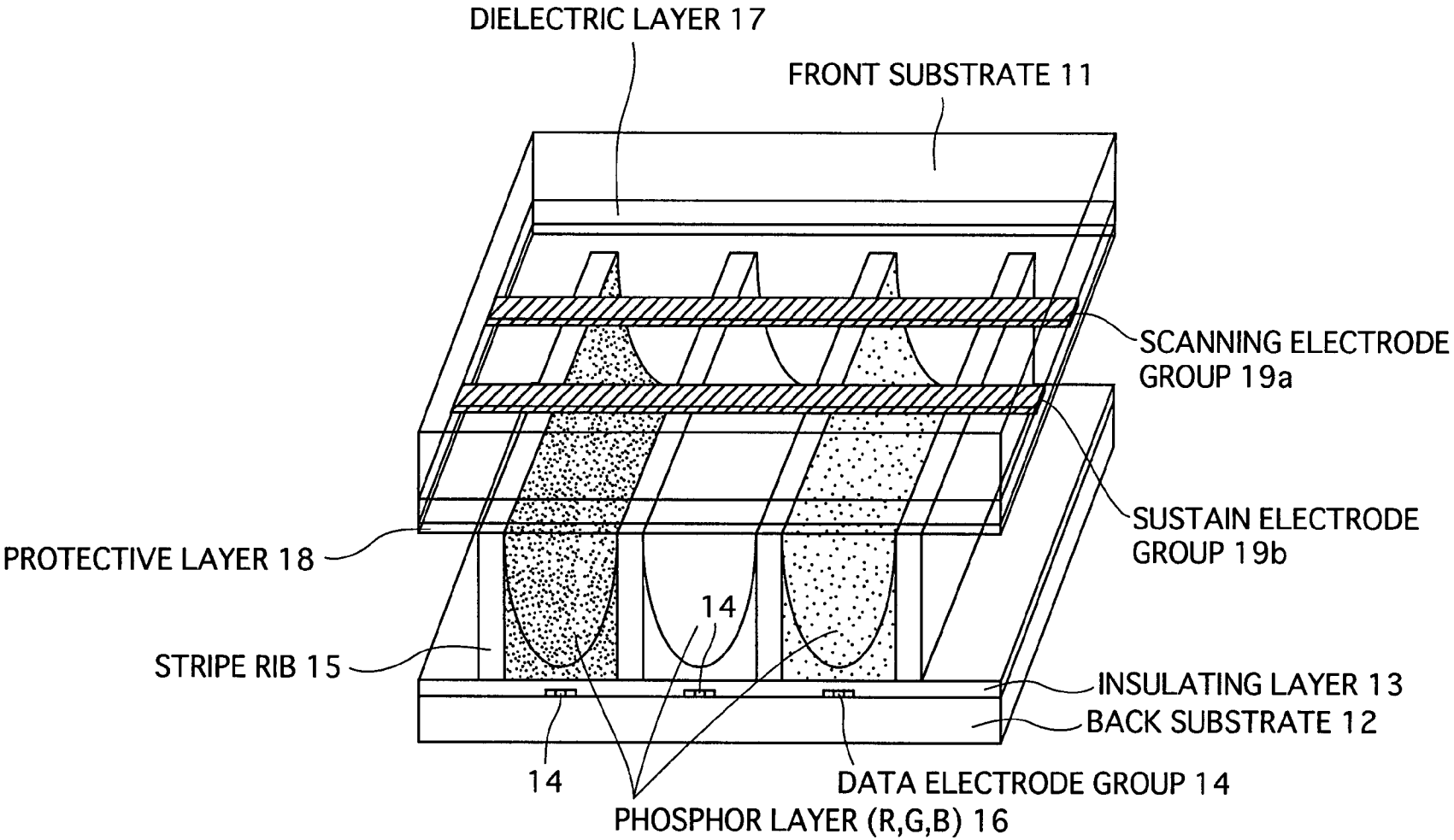
FIG. 1 shows the construction of the PDP in Embodiment.

FIG. 1 shows the construction of the PDP in the present embodiment.

In this PDP, a front substrate 11 and a back substrate 12 are placed in parallel so as to face each other with a space in between. The edges of the substrates are then sealed.

Scanning electrode group 19*a* and sustain electrode group 19*b* are formed in parallel strips on the inward-facing surface of the front substrate 11, forming a plurality of pairs of a scanning electrode and a sustain electrode. The electrode groups 19*a* and 19*b* are covered by a dielectric layer 17 composed of lead glass or similar. The surface of the dielectric layer 17 is then covered with a protective layer 18 of magnesium oxide (MgO). A data electrode group 14 is formed in parallel strips so as to be perpendicular to the scanning electrode group 19*a*, on the inward-facing surface of the back substrate 12. The data electrode group 14 is then covered by an insulating layer 13 composed of lead glass or similar. Stripe ribs 15 are placed on top of the insulating layer 13, in parallel with the data electrode group 14. The space between the front substrate 11 and the back substrate 12 is divided into spaces of 100 to 200 microns by the stripe ribs 15. Discharge gas is sealed in these spaces.

In monochrome PDPs, a gas mixture composed mainly of neon is used as the discharge gas, emitting visible light when discharge is performed. However, in a color PDP like the one in FIG. 1, a phosphor layer 16 composed of phosphors for the three primary colors red (R), green (G) and blue (B) is formed on the inner walls of the discharge cells, and a gas mixture composed mainly of xenon (such as neon-xenon or helium-xenon) is used as the discharge gas. Color display takes place by converting ultraviolet light generated by the discharge into visible light of various colors using the phosphor layer 16.

The pressure at which the discharge gas is enclosed is normally set in a range of between 200 to 500 torr (26.6 kPa–66.5 kPa) so that the pressure in an interior of the substrates is lower than the external pressure, assuming that the PDP is used under the atmospheric pressure.

Figure 2:
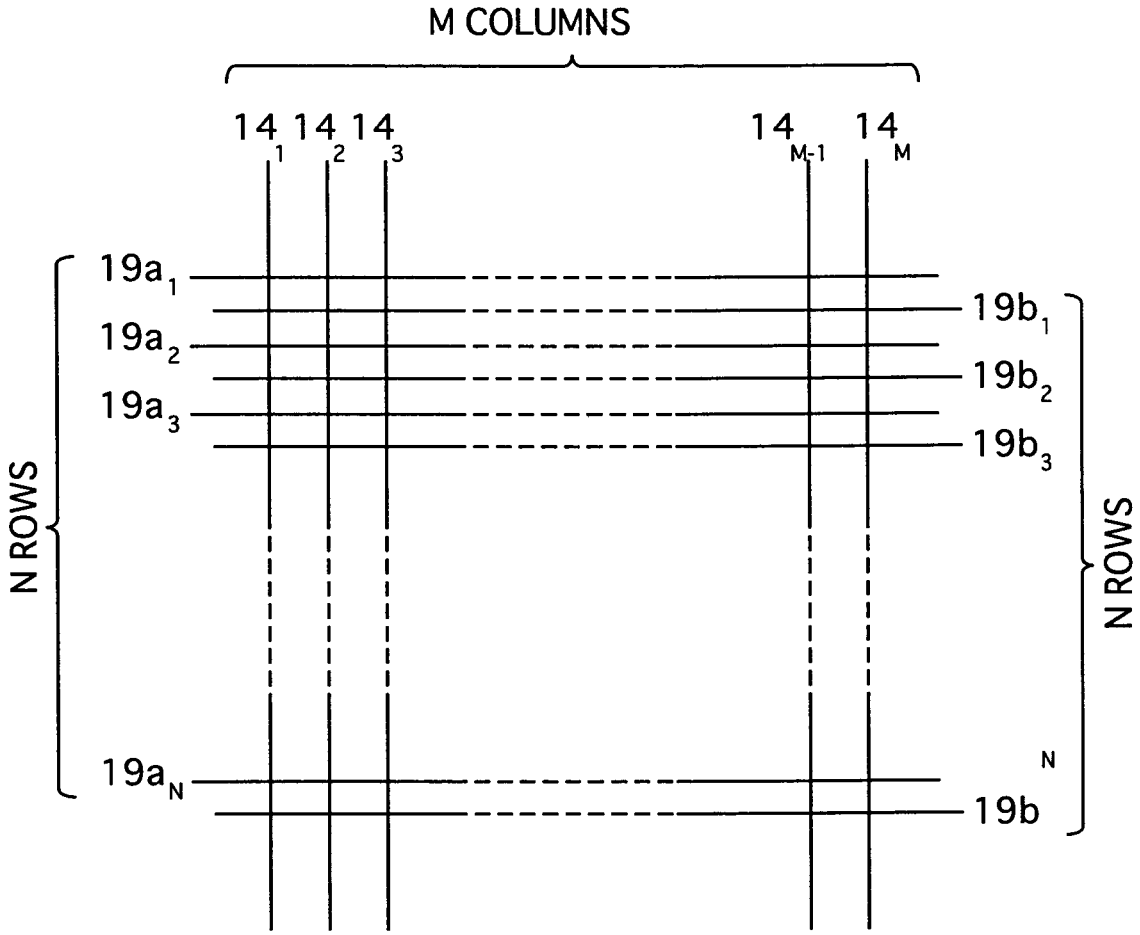
FIG. 2 shows an electrode matrix for the PDP.

FIG. 2 shows an electrode matrix for the PDP. The electrode groups 19*a* and 19*b* are arranged at right angles to the data electrode group 14. Discharge cells are formed in the space between the substrates 11 and 12, at the points where the electrodes intersect. The stripe ribs 15 separate adjacent discharge cells preventing discharge diffusion between adjacent discharge cells so that a high resolution display can be achieved.

In the present embodiment, each of the electrode groups 19*a* and 19*b* has a laminated structure of two layers: a layer of wide transparent electrodes having an excellent transmittance; and a layer of narrow bus electrodes (metal electrodes). Note that the transparent electrodes provide a broad light-emission area, and the bus electrodes provide conductivity.

It should be noted here that though in the present embodiment, transparent electrodes are used, metal electrodes may be used instead.

The following is an example of PDP production method.

A Cr thin layer, a Cu thin layer, and a Cr thin layer are formed on a surface of the glass substrate in the stated order by a sputtering method. A resist layer is further formed. The resist layer is exposed via a photo mask having an electrode pattern, and then developed. Unnecessary portions are then removed from the Cr/Cu/Cr layers by a chemical etching method. This completes the patterning. The dielectric layer 17 is formed by printing a low-melting point lead glass type paste, then drying and baking it. The protective layer 18, an MgO layer, is formed by an electron-beam evaporation method.

The data electrode group 14 is formed by printing a pattern of thick-layer silver paste on a surface of a glass substrate, which is to be the back substrate 12, by a screen printing method, and then baking the printed paste. The insulating layer 13 is formed by printing an insulator glass paste by a screen printing method, and then baking the printed paste. The stripe ribs 15 are formed by printing a pattern of thick-layer paste by a screen printing method, and then baking the printed paste. The phosphor layer 16 is formed by printing a pattern of phosphor ink on the sides of each stripe rib 15 and on the insulating layer 13 by a screen printing method, and then baking the printed ink. An Ne—Xe mixture gas containing 5% of Xe is then enclosed as a discharge gas at a pressure of 500 Torr (66.5 kPa).

Driving Method

The PDP is driven by a driving circuit using the in-field time division gray scale display method.

Figure 3:
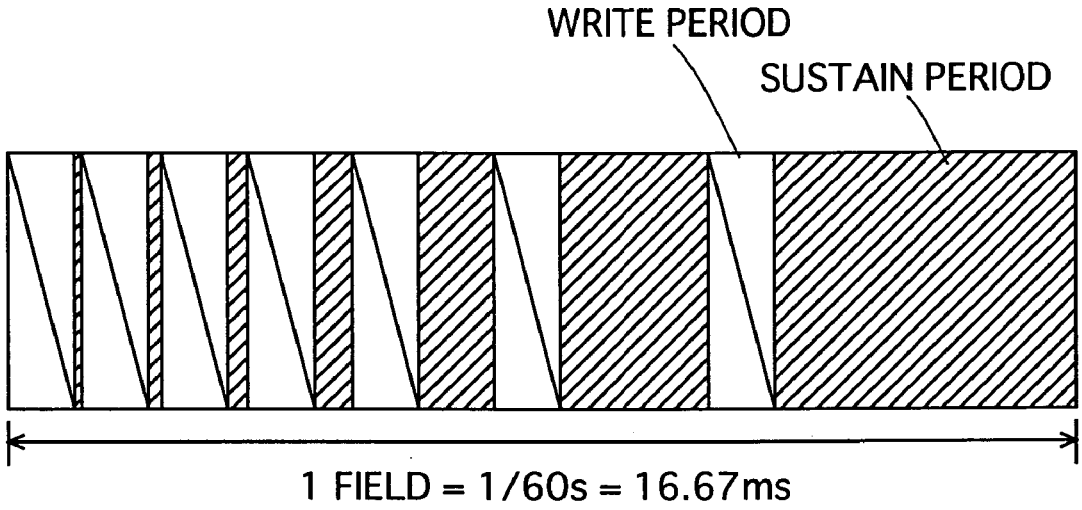
FIG. 3 shows a field division method for one field.

FIG. 3 shows a division method for one frame when a 256-level gray scale is expressed. The horizontal axis shows time and the shaded parts show discharge sustain periods.

In the example division method shown in FIG. 3, one frame is made up of eight sub-frames. The ratios of the discharge sustain period for the sub-frames are set respectively at 1, 2, 4, 8, 16, 32, 64, and 128. These eight-bit binary combinations express 256 gray scale levels. The NTSC (National Television System Committee) standard for television images stipulates a frame rate of 60 frames per second, so the time for one frame is set at 16.7 ms.

Each sub-frame is composed of the following sequence: an initialization period, a write period, a discharge sustain period and an erase period.

Figure 4:
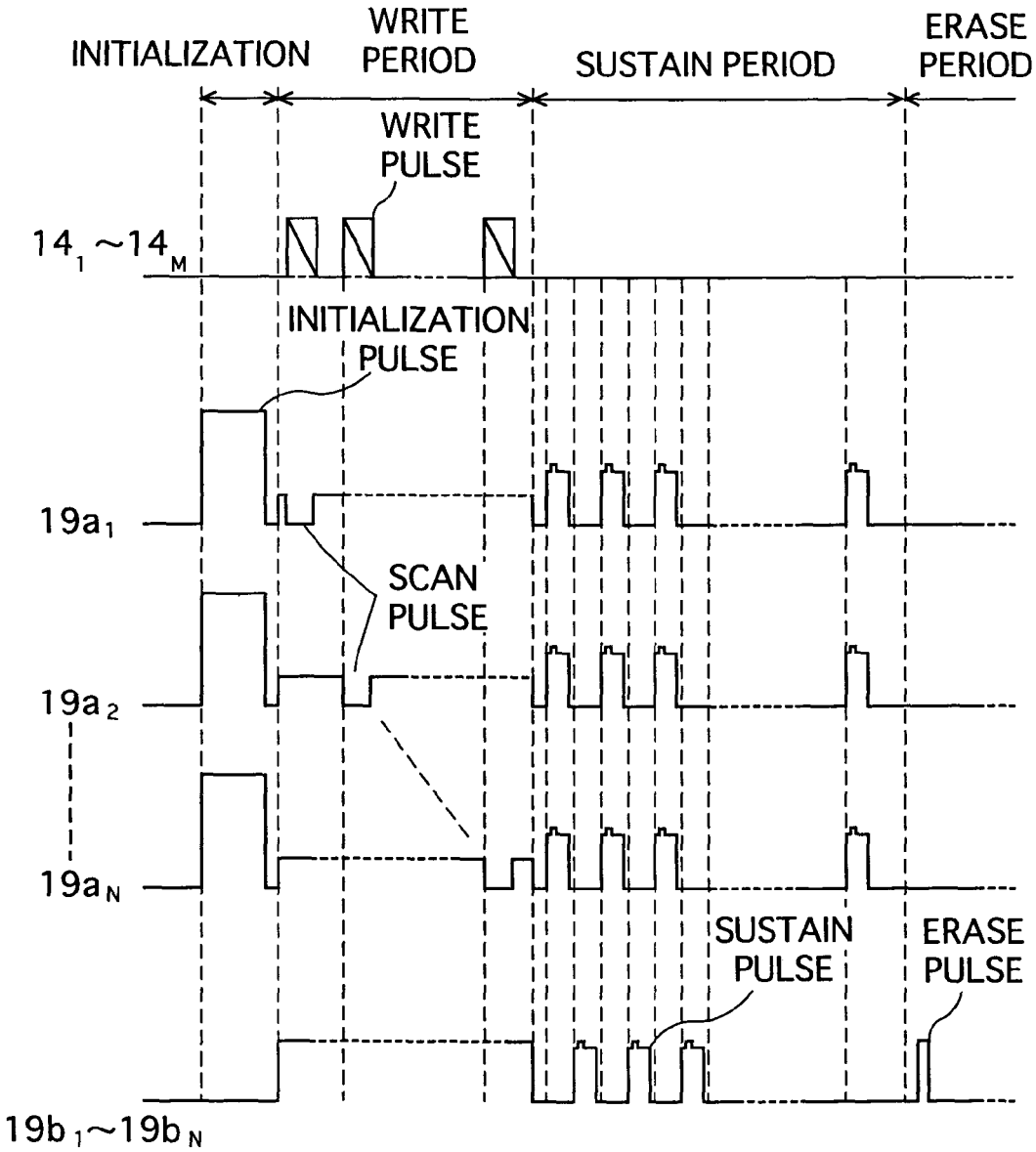
FIG. 4 is a time chart showing when pulses are applied to electrodes during one sub-frame.

FIG. 4 is a time chart showing when pulses are applied to electrodes during one sub-frame.

In the initialization period, all the discharge cells are initialized by applying initialization pulses to all of the scan electrodes 19*a*.

In the write period, data pulses are applied to selected data electrodes 14 while scan pulses are applied sequentially to the scan electrodes 19*a*. This causes a wall charge to accumulate in the cells to be ignited, writing one screen of pixel data.

In the discharge sustain period, the data electrode group 14 is grounded, and a sustain pulse is applied alternately to the scan electrodes 19*a* and the sustain electrodes 19*b*. This causes the discharge cell having accumulated the wall charge to maintain a main discharge for a discharge sustain period, emitting light.

In the erase period, narrow erase pulses are applied in bulk to the scan electrodes 19*a*, causing the wall charges in all of the discharge cells to be erased.

Characteristics and Effects of Sustain Pulse Waveform

In the sustain period, a sustain pulse having a staircase waveform that rises in two steps and falls also in two steps is used. Although it is assumed here that the sustain pulse has a straight polarity, similar results will be obtained if it has a negative polarity.

Figure 5A:
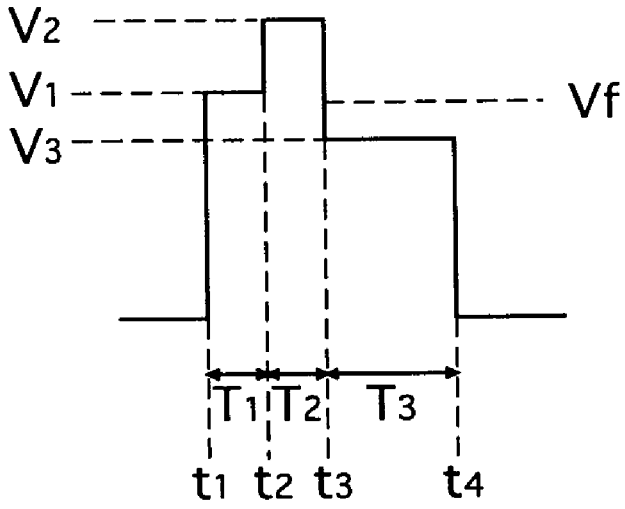
FIGS. 5A and 5B show waveforms of the sustain pulse and discharge current.
Figure 5B:
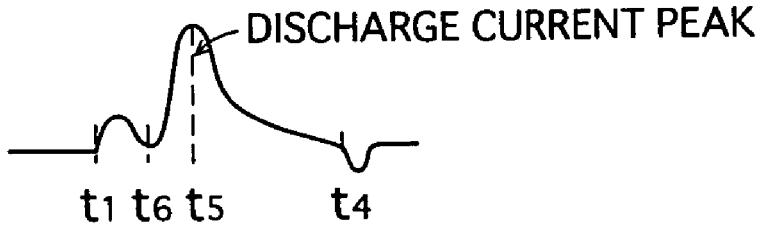

FIG. 5A shows the waveform of the sustain pulse (a change, with time, of the voltage applied to the scanning electrodes or sustain electrodes). FIG. 5B shows a discharge current waveform that is generated when the sustain pulse shown in FIG. 5A is applied to the scanning electrodes or sustain electrodes.

As shown in FIG. 5A, the sustain pulse has a staircase waveform, and is composed of: a first waveform portion (first period T1) sustained by a voltage V1 that is close to a discharge start voltage Vf; a second waveform portion (second period T2) following the first period and sustained by a voltage V2 that is higher than the voltage V1; and a third waveform portion (third period T3) following the second period and sustained by a voltage V3 that is lower than the voltage V2.

The voltage level for each period is set as follows.

The voltage V1 for the first period T1 is set to be close to the discharge start voltage Vf, and preferably to a range satisfying "$Vf-20V \leqq V1 \leqq Vf+30V$". Normally, voltage V1 is set to a range "$100V \leqq V1 \leqq 200V$".

The discharge start voltage Vf is a discharge start voltage applied to the scanning electrodes 19*a* and the sustain electrodes 19*b* and is a value at the driving apparatus. The discharge start voltage Vf is a fixed value determined by the construction of the PDP. For example, the discharge start voltage Vf can be measured by gradually increasing a voltage applied to the scanning electrodes 19*a* and the sustain electrodes 19*b* and reading the voltage value when the discharge cells start to emit light.

The voltage V2 for the second period T2 is set to a value no lower than "V1+10V". When the voltage V2 for the second period T2 is set to be higher than the voltage V1 for the first period T1, the luminous efficiency is improved. When the voltage V2 for the second period T2 is set to a value no lower than "V1+40V", the luminous efficiency is further improved.

It is desirable that the voltage V2 is set to a value no higher than 2V1 since if the voltage V2 is higher than 2V1, a self erasure is apt to happen at the rise and fall in the second period.

The voltage V2 is preferably set to a range satisfying "Vf≦V2≦Vf+150V" if it is represented with reference to the discharge start voltage Vf.

The voltage V3 for the third period T3 is set to a voltage value that is lower than the voltage V2 for the second period T2 and is enough to maintain the wall charge that is required when the next sustain pulse is applied. This prevents the self erasure from occurring at the fall in the third period, suppressing the loss of wall charge by the self erasure. To secure this effect, it is preferable that the voltage V3 is set to a value lower than the voltage V1 and in a range satisfying "V1−100V≦V3≦V1−10V", and it is preferable that the voltage V3 is set to a value lower than the discharge start voltage Vf if it is represented with reference to the discharge start voltage Vf.

The timing for each period is set as follows.

As shown in FIG. 5A, t1 indicates a sustain pulse application start point, t2 indicates a boundary point between the first period T1 and the second period T2 (that is, a rise start point of the second step), t3 indicates a boundary point between the second period T2 and the third period T3 (that is, a fall start point), and t4 indicates a sustain pulse application end point. Also, t5 indicates a point at which the discharge current is at the maximum, and t6 indicates a point at which a discharge current starts to rise toward the peak.

Here, at the point t5 when the discharge current is at the maximum, a "discharge delay time Tdf" has elapsed from the application start point t1.

In the sustain pulse of the present embodiment, the length of the first period T1 is set to be shorter than the discharge delay time Tdf. It is preferable however that a time period "(Vf−20V) to (Vf+30V)" is set to a value no shorter than 20 ns.

The reason why the length of the first period T1 is set to be shorter than the discharge delay time Tdf is as follows.

Typically, the discharge delay time when the sustain pulse is applied is approximately 600–700 ns. The higher the applied voltage is, the shorter the discharge delay time is (the discharge delay time is approximately indirectly proportional to the second power of the voltage).

In the present embodiment, the discharge delay time Tdf when the sustain pulse is applied is substantially determined by the size of the voltage V1 for the first period. Accordingly, in the present embodiment, a discharge delay time that is measured when a simple rectangular wave (voltage V1) is applied can be regarded as the discharge delay time Tdf.

Also, when a variety of discharge formation delay times are generated, the shortest discharge delay time may be regarded as the discharge delay time. With this arrangement, the voltage V2 is applied with reliability when the discharge current is at the maximum.

Here, when the length of the first period T1 is set to be shorter than the discharge delay time Tdf as described above, the second rise start point t2 is before the point t5 at which the discharge current is at the maximum. Accordingly, the applied voltage is higher than the voltage V1 and there is a high possibility that it is the voltage V2, which is the highest voltage, when the discharge current is at the maximum. That is to say, there is a high possibility that the applied voltage is the voltage V2, which is the highest voltage, at the point t5 when the discharge current is at the maximum (in other words, applications of high voltages concentrate on the times when the amount of current is great). This causes the current to be used for light emission efficiently. This accordingly enables the PDP to emit light with high luminance and high efficiency.

A time of several hundred ns elapses from the point t6 at which the discharge starts to the point t5 at which the discharge current is at the maximum. Accordingly, by setting the length of the first period T1 to no higher than "discharge delay time Tdf−0.2 μsec", it is achieved with more reliability that the voltage V2, which is the highest voltage, is applied at the point t5 when the discharge current is at the maximum.

Also, the second step rise start point t2 may be set to a point immediately after the discharge current start point t6 (that is, set to a range of 20–50 ns after the discharge current start point t6). It is preferable for example that the second step rise start point t2 is set to a point immediately after the discharge current start point t6 so that the applied voltage reaches the highest voltage V2 before the point t5 when the discharge current is at the maximum, and that the discharge current end point substantially matches the fall start point t3.

The fall start point t3 is set to a range of time in which the discharge current is falling. Typically, the fall start point t3 is set to a range of 100–150 ns after the second step rise start point t2. An appropriate length of the second period T2 is in a range of 100–800 ns. An appropriate length of the third period T3 is in a range of 1–5 μsec.

Meanwhile, during the third period T3, which is a certain time after the point t5 at which the discharge current is at the maximum, the discharge current is lower than its maximum value and is further falling.

Also, the third period T3 is 150 ns or more after the second step rise start point t2. That is to say, a lot of time has elapsed from the discharge start. As a result, the current during the third period T3 poorly contributes to the excitation of Xe.

Here, if voltage V3 is set to be identical with voltage V1, as much power not contributing to the light emission is consumed in the third period. However, in the present embodiment, since voltage V3 is set to lower than voltage V1 as described above, consumption of power not contributing to the light emission is suppressed.

In other words, according to the sustain pulse waveform of the present embodiment, the power consumption during the first and third periods that poorly contribute to the excitation of Xe is suppressed, and the power consumption concentrates on the second period in which the discharge current greatly contributes to the excitation of Xe.

In the second period, in which high voltage V2 is applied as described above, enough amount of space charge is generated. As a result, if voltage V3 for the third period is set to a low value, enough amount of wall charge to generate discharge at the next application of a sustain pulse is accumulated.

Furthermore, using the above-described staircase waveform for the sustain pulse allows a high voltage to be applied at around a point at which the discharge current is at the maximum. This increases the speed at which the discharge spreads. That is to say, the discharge current peak has a relatively short length of time and is intensive.

Accordingly, if a high-speed driving is performed by setting the pulse width of the sustain pulse (a total time of the first, second, and third periods T1, T2, and T3) to be short (several μsec), a discharge sustain operation is ensured.

As described above, use of the above-described staircase waveform for the sustain pulse is suitable for displaying PDP with high definition and high luminance since it provides a highly efficient light emission and a high-speed driving.

Other preferable settings are as follows.

It is preferable that the voltage change during a discharge time is observed as a trigonometric function, where the discharge time is a duration between (a) the end of a charge period in which geometrical capacitance for the discharge cells is charged and (b) the end of the discharge current.

It is preferable from the viewpoint of improving the luminous efficiency that if the second period is raised as a trigonometric function, the second period is raised during a discharge period Tdise in which the discharge current flows.

It is preferable that the applied voltage waveform rises as a trigonometric function during a discharge period that is a duration between immediately after the start of the first period and a point at which the discharge current is at the maximum, and that the applied voltage waveform changes as a trigonometric function over a discharge time until the discharge current ends in the third period.

If both rises in the first and second periods are represented as trigonometric functions, the rise in the first period is completed during a discharge period Tdscp that is a duration between the start of a discharge period dise and a point at which the discharge current is at the maximum, and the rise in the second period is completed in a duration between the point at which the discharge current is at the maximum and the end of the discharge period dise.

Here, the discharge period Tdise is a duration between (a) the end of a charge period Tchg in which the capacitance for the discharge cells is charged and (b) the end of the discharge current. The capacitance for the discharge cells may be regarded as being equivalent to the geometrical capacitance determined by the construction of the discharge cells that are formed by the scanning electrodes, sustain electrodes, dielectric layer, discharge gas or the like. As a result, it is also possible to define the discharge period Tdise as "a duration between (a) the end of a charge period Tchg in which the geometrical capacitance for the discharge cells is charged and (b) the end of the discharge current".

Use of Electricity Recovery Circuit

In the actual PDP circuit, an electricity recovery circuit, which will be detailed later, is used. The electricity recovery circuit drives so that the phase difference between the voltage and the current is reduced at the rise and fall. This suppresses generation of the reactive current in the driving circuit, and provides a waveform in which the edges of the rise and fall are blunt.

Figure 6:
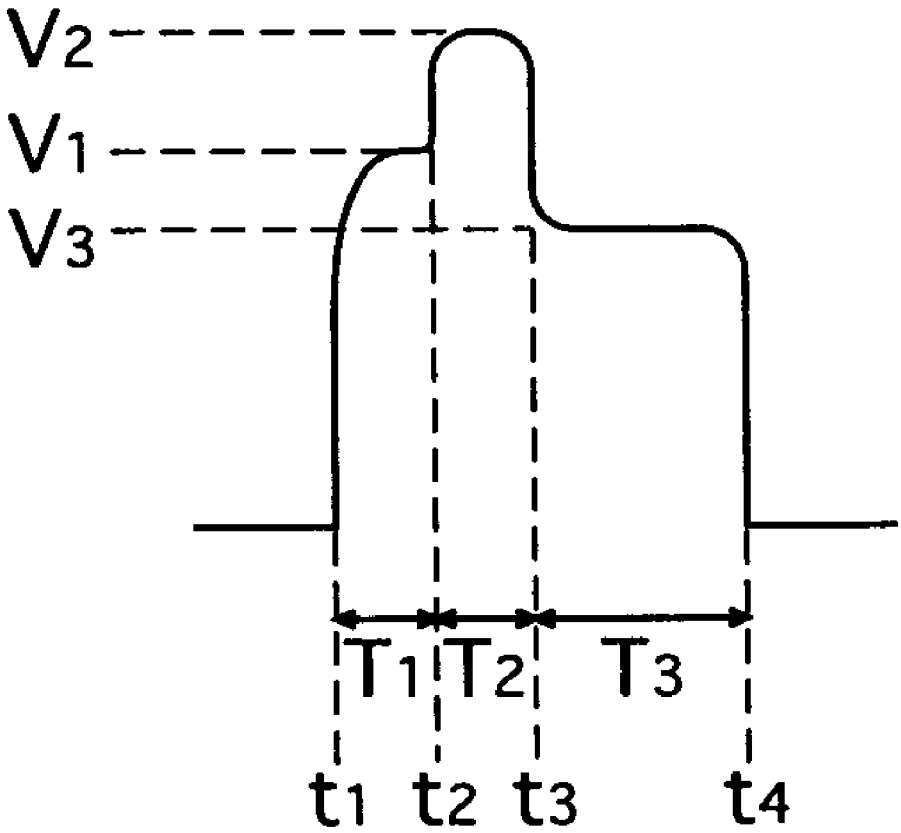
FIG. 6 shows a sustain pulse waveform that is observed when the electricity recovery circuit is used.

In the waveform shown in FIG. 5A, rises and falls immediately after the application start point t1, second step rise start point t2, and point t3 are very steep. FIG. 6 shows a waveform that is observed when the electricity recovery circuit is used. In the waveform shown in FIG. 6, the edges of the rise and fall are blunt (the voltage changes as a trigonometric function), though it is the staircase waveform having the same characteristics as that shown in FIG. 5A. In the waveform shown in FIG. 6, each rise or fall takes a time of approximately 400–500 ns.

When use of the electricity recovery circuit for efficient electricity recovery is taken into account, it is preferable that the rise tilts immediately after the points t1 and t2 are both set to be close to the optimum values, respectively. In general, however, the optimum values are different from each other. Accordingly, when the electricity recovery efficiency is taken into account, it is preferable that the rise tilts immediately after the points t1 and t2 are set independently.

Explanation of Effects Based on V-Q Lissajous's Figure

Figure 7:
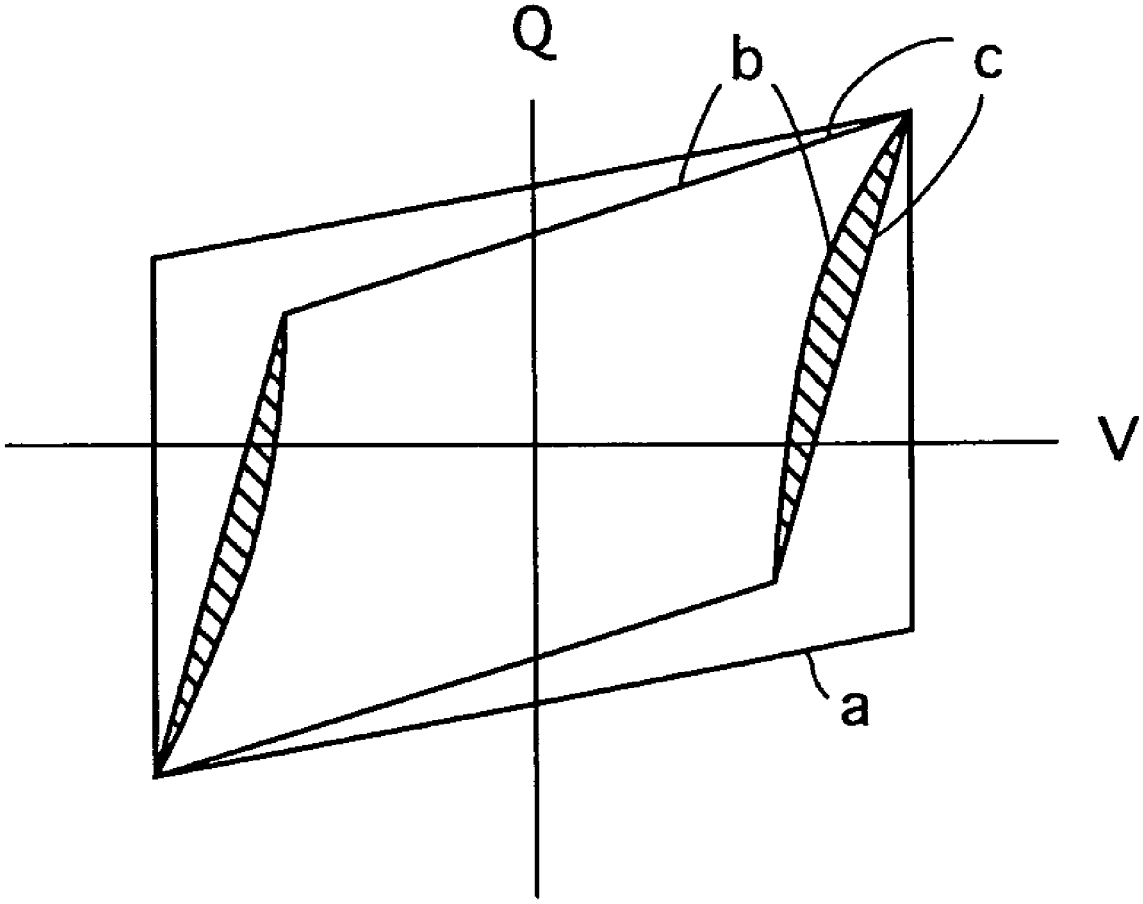
FIG. 7 is an example of a V-Q Lissajous's figure.

FIG. 7 is an example of a V-Q Lissajous's figure. In this figure, the loop "a" schematically represents a case where the PDP is driven using a sustain pulse having a simple rectangular waveform, and the loop "b" schematically represents a case where the PDP is driven using a sustain pulse having the above-described staircase waveform.

The V-Q Lissajous's figures show how the quantity of electric charge Q changes forming a loop. There is a relationship that the area of a loop in the V-Q Lissajous's figures is approximately proportionate to an amount of power consumed in discharge.

The quantity of electric charge Q accumulated in the discharge cells can be measured by connecting the PDP with a wall charge amount measuring apparatus that uses the same principle as the Sawyer-Tower circuit that is used for evaluating ferro electric characteristics or the like.

The loops "a" and "b" are both V-Q Lissajous's figures and parallelograms, but the loop "b" is distorted and narrower than the loop "a". Also, the loop "b" has arc-shaped sides.

The narrower the parallelogram is, the smaller the loop area is. This indicates that when the parallelogram is narrow, while the amount of charge moving in the discharge cells does not change, and the amount of emitted light does not change, the amount of power consumption in the PDP is small.

As described above, when the staircase waveform is used, the loop "b" becomes narrower. It is considered that this is because the second period, in which the high-level voltage V2 is applied, follows the first period. Also, another reason why the loop reduces in the direction of Q (vertical direction in the drawings) is that the third period, in which a voltage lower than the discharge start voltage is applied, follows the second period.

Figure 8:
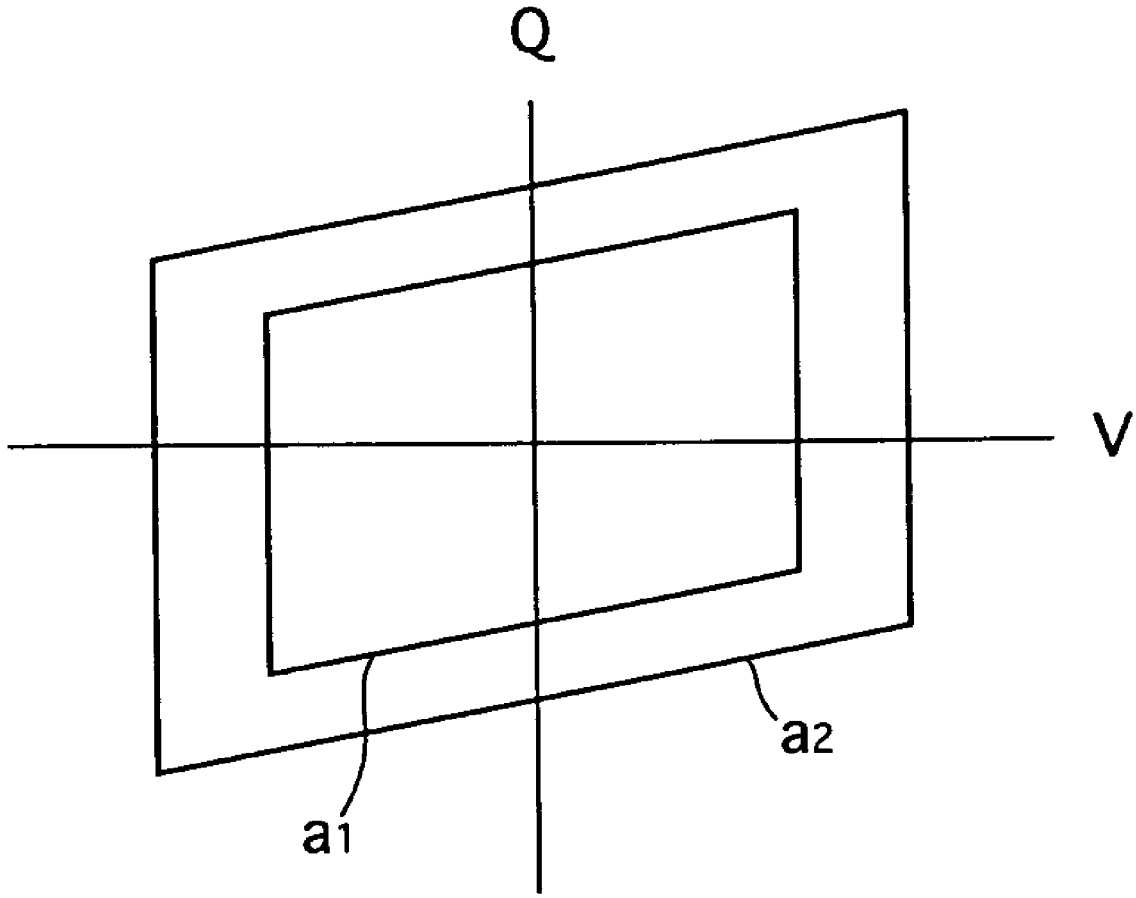
FIG. 8 is an example of a V-Q Lissajous's figure.

FIG. 8 is a V-Q Lissajous's figure when the PDP is driven using a sustain pulse having a simple rectangular waveform. When a simple rectangular waveform is used, the higher the driving voltage is, the higher the luminance is. In the case of a V-Q Lissajous's figure, the loop expands in similar figures (as understood from "a1" expanding to "a2" in FIG. 8). That is to say, as the driving voltage increases, the discharge current increases, thus the amount of power consumption increases, as well. In this case, the luminous efficiency of the PDP is not improved.

Suppose that only the second and third periods are set without the first period (that is, the voltage is drastically increased to a high level immediately after the rise start, and the fall has a shape of staircase). In this case, the loop extends in the direction of V (horizontal direction in the drawings), compared with the rectangular waveforms. In this case, though the luminance increases, the luminous efficiency hardly changes.

Driving Circuit

Figure 9:
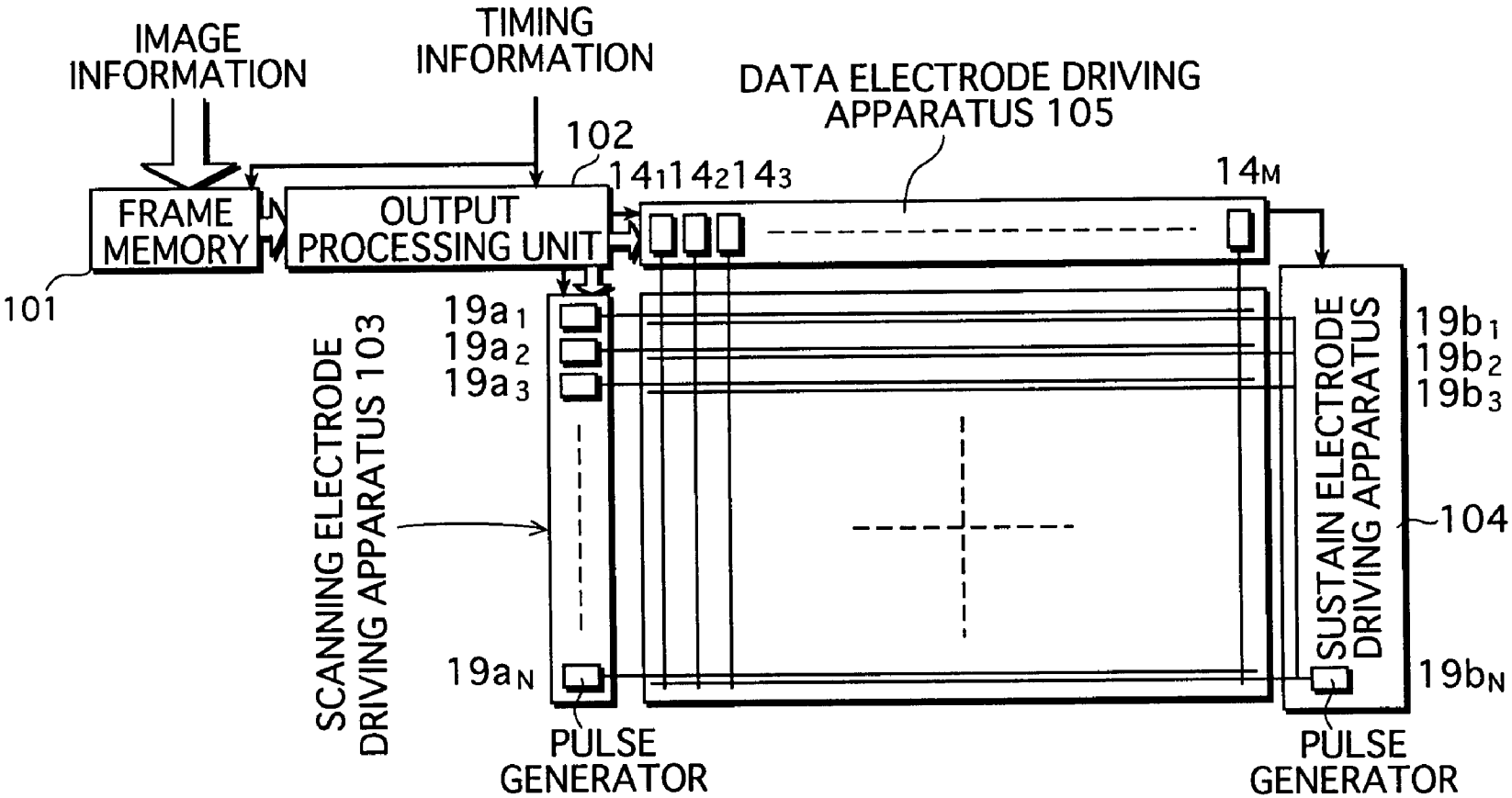
FIG. 9 is a block diagram of the driving circuit for driving the PDP.

FIG. 9 is a block diagram of the driving circuit for driving the above-described PDP.

The driving circuit includes a frame memory 101 for storing input image data; an output processing unit 102 for processing the image data; a scanning electrode driving apparatus 103 for applying a pulse to the scanning electrode group 19*a*; a sustain electrode driving apparatus 104 for applying a pulse to the sustain electrode group 19*b*; and a data electrode driving apparatus 105 for applying a pulse to the data electrode group 14.

The frame memory 101 stores pieces of subfield image data that are generated from image data for one field and correspond to the subfields respectively.

The output processing unit 102 outputs current subfield image, which is stored in the frame memory 101, to the data electrode driving apparatus 105 one line by one line. The output processing unit 102 also sends a trigger signal, which provides pulse application timing, to the electrode driving apparatuses 103–105, based on the timing information (for example, a horizontal sync signal or a vertical sync signal) that synchronizes with the input image information.

The scanning electrode driving apparatus 103 has pulse generation circuits that correspond to the scanning electrodes on a one-to-one basis and are driven in response to trigger signals sent from the output processing unit 102. This construction enables a scanning pulse to be applied in sequence to all scanning electrodes 19*a*1–19*a*N in the write period, and enables initialization and sustain pulses to be applied to all scanning electrodes 19*a*1–19*a*N at once in the initialization and sustain periods, respectively.

The sustain electrode driving apparatus 104 has pulse generation circuits that are driven in response to trigger signals sent from the output processing unit 102 and apply sustain and erase pulses to all scanning electrodes 19*a*1–19*a*N at once in the sustain and erase periods, respectively.

The data electrode driving apparatus 105 has pulse generation circuits that are driven in response to trigger signals sent from the output processing unit 102 and apply the data pulse to data electrodes selected from the data electrode group 14 composed of data electrodes 14*a*–14M, based on the subfield information.

The pulse generators of the scanning electrode driving apparatus 103 and the sustain electrode driving apparatus 104 generate sustain pulses having a staircase waveform. The mechanism of this will be described now.

A two-step rise staircase waveform or a two-step fall staircase waveform is generated by causing two pulse generators, which are connected with each other by the floating ground method, to generate rectangular pulses that overlap with each other over time.

Figure 10A:
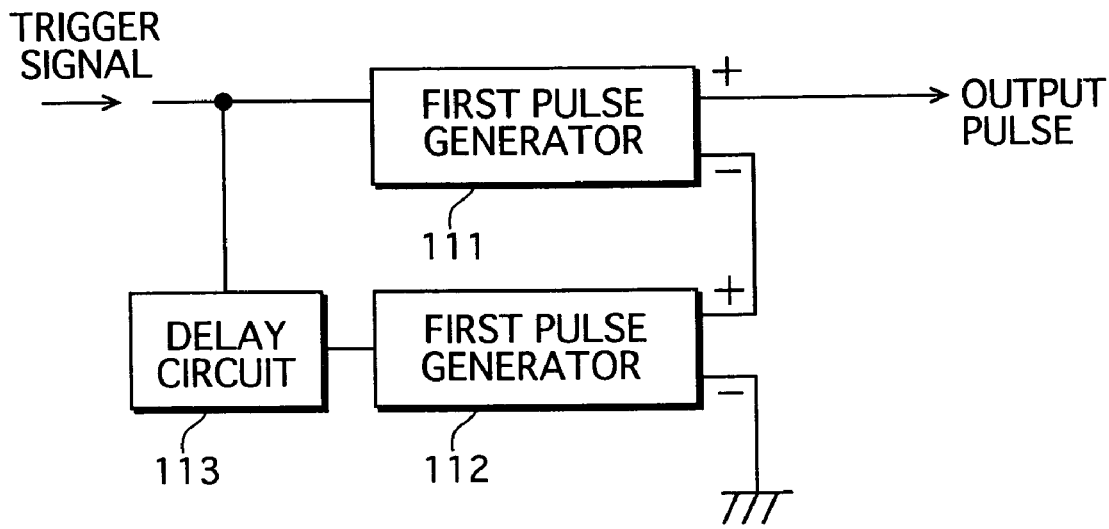
FIGS. 10A and 10B show an overlapped-pulse generation circuit for generating a pulse that changes in a staircase shape having two steps of rising, and how the overlapped-pulse generation circuit generates a pulse that changes in a staircase shape having two steps of rising.

An example of such is shown in FIG. 10A. FIG. 10A is a block diagram of an overlapped-pulse generation circuit for generating a pulse that changes in a staircase shape having two steps of rising.

The overlapped-pulse generation circuit includes a first pulse generator 111, a second pulse generator 112, and a delay circuit 113. The first pulse generator 111 is connected with the second pulse generator 112 in series by the floating ground method so that output voltages are added up.

Figure 10B:
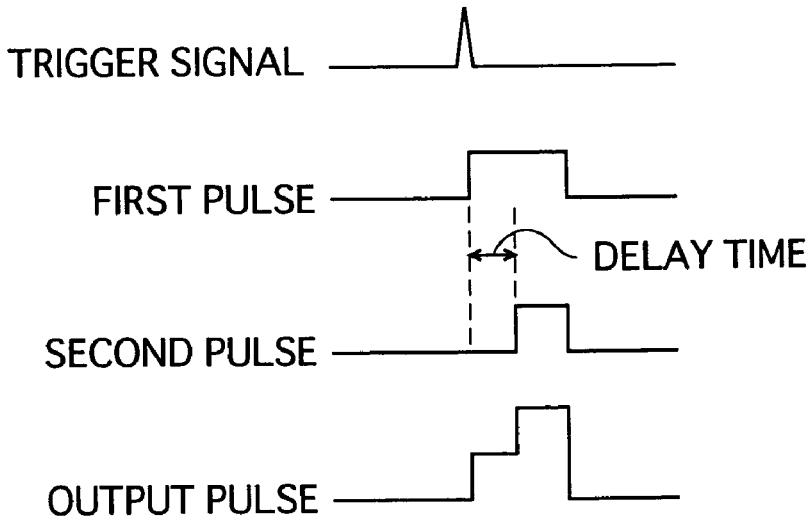

FIG. 10B shows how the overlapped-pulse generation circuit causes the first pulse to overlap with the second pulse to generate a pulse that changes in a staircase shape having two steps of rising.

The first pulse generator 111 generates a first pulse that is a rectangular wave having a relatively large width over time, and the second pulse generator 112 generates a second pulse that is a rectangular wave having a relatively small width.

In response to the trigger signal output from the output processing unit 102, first the first pulse generator 111 raises the first pulse, and a certain time later, as a delay caused by a delay circuit 113, the second pulse generator 112 raises second pulse.

With the above-described operation, the first and second pulses overlap each other, and the pulse output as a result of this has a two-step rise staircase form.

In FIG. 10B, the first and second pulses fall at the same time. This is because the pulse widths of them are set to such values as achieve this. However, it is also possible to generate an output pulse having a two-step fall staircase form by setting the pulse width of the second pulse to a smaller value so that the second pulse falls earlier than the first pulse.

Also, a third pulse generator may further be connected to the first pulse generator 111 and the second pulse generator 112 by the floating ground method. With this construction, it is possible to set the voltage V1 of the first period T1, the voltage V2 of the second period T2, and the voltage V3 of the third period to different values.

It is also possible to cause a sustain pulse to rise and/or fall as a trigonometric function by adding such an electricity recovery circuit as will be described below to the driving circuit.

Figure 11A:
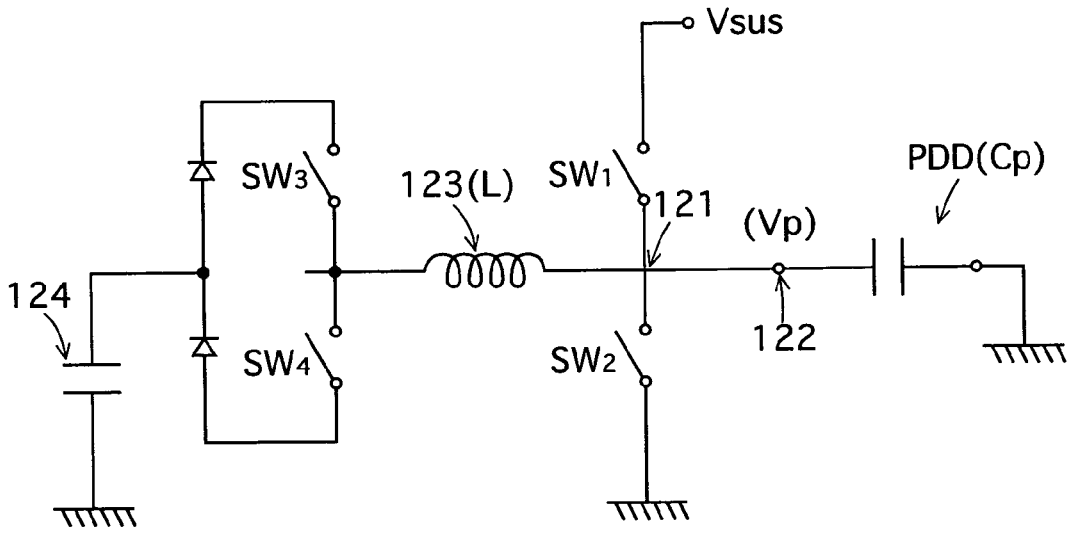
FIGS. 11A and 11B show the principle of the electricity recovery circuit.
Figure 11B:
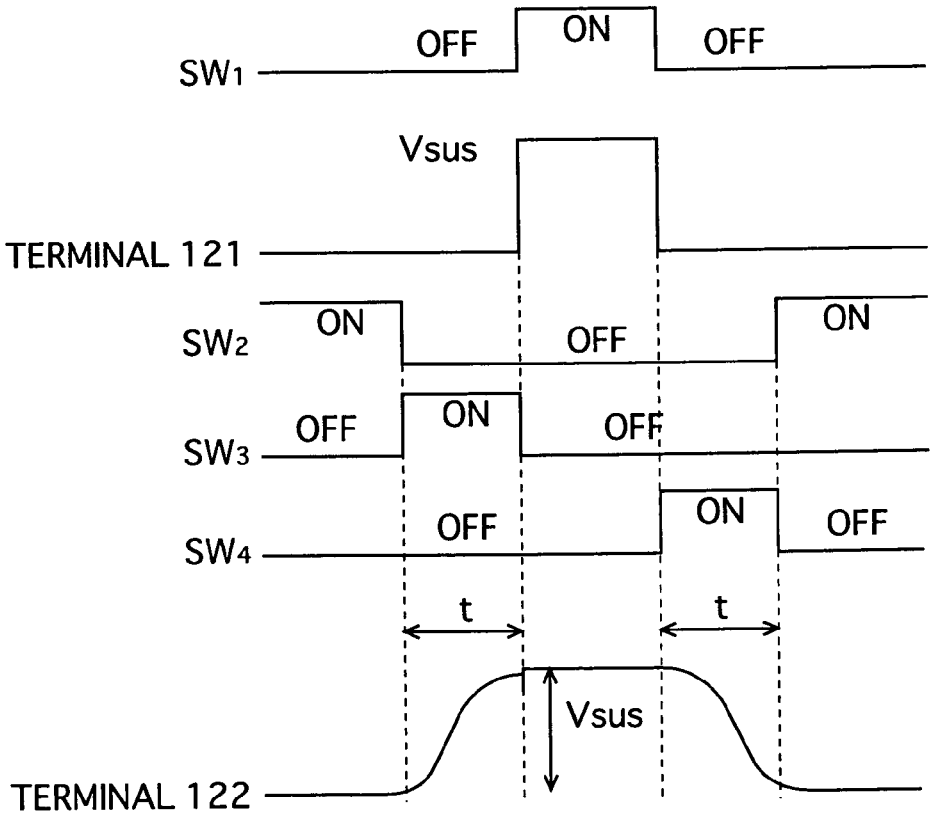

FIGS. 11A and 11B show the principle of the electricity recovery circuit. FIG. 11A shows the circuit construction. FIG. 11B shows the operation timing.

It should be noted here that although in this example, for the sake of convenience, the electricity recovery circuit is attached to a pulse generator that generates a pulse having a simple rectangular waveform, it is also possible to attach the electricity recovery circuit to a pulse generator that generates a pulse having a staircase waveform.

In this electricity recovery circuit, switches SW1–SW4 turns ON/OFF with the timing shown in FIG. 11B.

The switch SW1 corresponds to a main FET (Field-Effect Transistor), and turns ON/OFF the connection between the power (Vsus) and an input terminal 121. With this operation, a rectangular wave (Vsus) is input into the input terminal 121, as shown in FIG. 11B.

The input terminal 121 is earthed via the switch SW2, is connected to an electrode (a scanning electrode or a sustain electrode) in the PDP via an output terminal 122, and is connected in series to a coil 123 and a capacitor 124. The switches SW3 and SW4 are inserted between the coil 123 and the capacitor 124.

As shown in FIG. 11B, the switches SW2–SW4 turn ON/OFF with the timing when the switch SW1 turns ON/OFF. More specifically, the switch SW3 turns ON during a period $\tau$ immediately before the switch SW1 turns ON, and the switch SW4 turns ON during a period $\tau$ immediately after the switch SW1 turns OFF.

Here, the period $\tau$ corresponds to a time period expressed as $(\pi r/2)\times(LCp)^{1/2}$, where "L" represents the self inductance of the coil 123, and "Cp" represents the capacity of the PDP.

With the above-described operation, during the period $\tau$ in which the switch SW3 turns ON, the charge collected in the capacitor 124 is supplied to the PDP via the coil L, and the voltage Vp of the output terminal 122 rises as a trigonometric function. On the other hand, during the period $\tau$ in which the switch SW4 turns ON, the charge in the PDP is collected in the capacitor 124 via the coil L, and the voltage Vp of the output terminal 122 falls as a trigonometric function.

If the electricity recovery circuit is applied to the pulse generators in the driving circuit, the output sustain pulse rises and falls as a trigonometric function and the electricity is recovered.

EMBODIMENT 2

Figure 12:
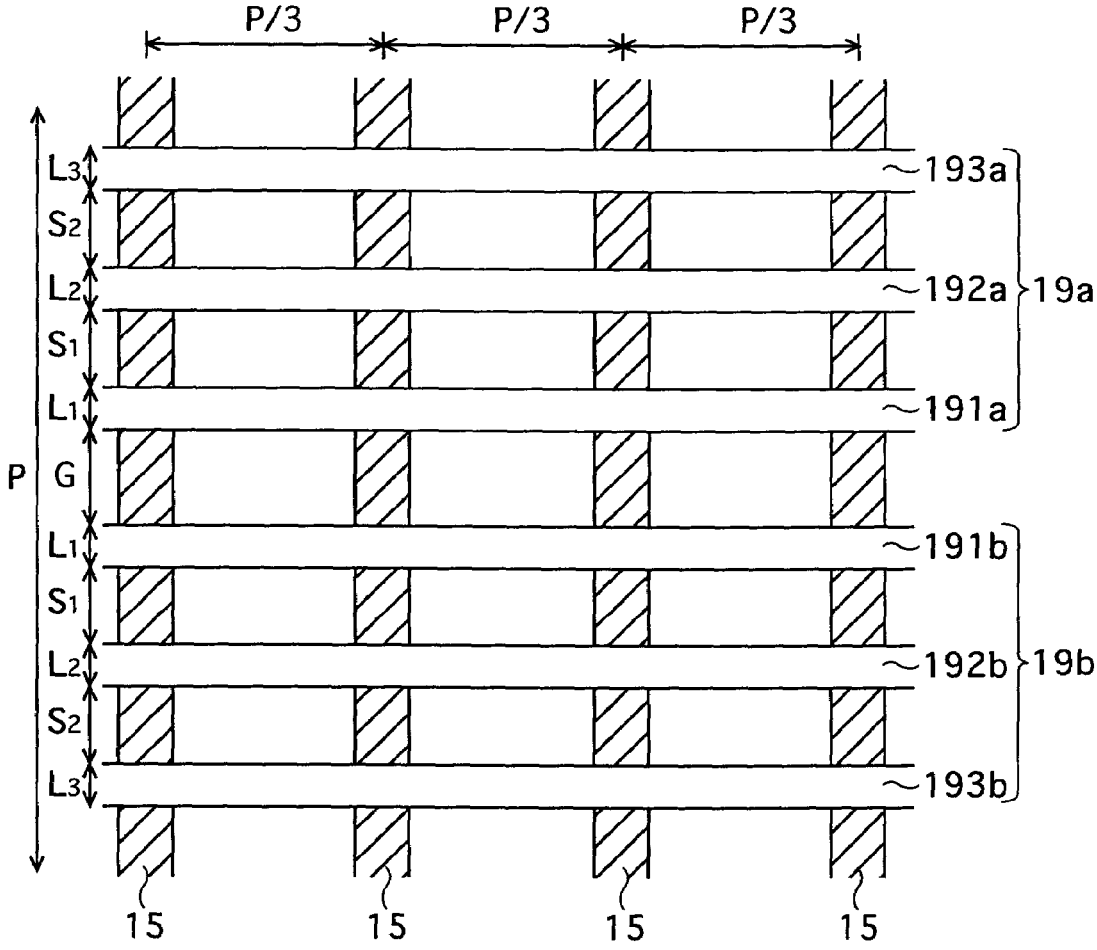
FIG. 12 is a schematic illustration of an electrode pattern in Embodiment 2.

FIG. 12 is a schematic illustration of an electrode pattern in the present embodiment.

The driving waveform applied to each electrode by the driving circuit in the present embodiment is the same as Embodiment 1. In the present embodiment, the sustain pulse has the two-step rise/fall staircase waveform shown in FIGS. 5A, 5B, and 6. The PDP in the present embodiment has the same construction as that in Embodiment 1, except for the electrode construction as the following description will show.

In Embodiment 1, each of the electrode groups 19*a* and 19*b* has a laminated structure of two layers: a layer of transparent electrodes; and a layer of metal electrodes. Different from this, Embodiment 2 has a split electrode (FE electrode) structure in which each of the electrode groups 19*a* and 19*b* is divided into thin line electrodes.

As shown in FIG. 12, the scanning electrode 19*a* is composed of three line electrodes 191*a*–193*a* that are parallel to each other. Similarly, the sustain electrode 19*b* is composed of three line electrodes 191*b*–193*b* that are parallel to each other. It should be noted here that the number of line electrodes may be two or four or more instead of three.

The width L of each line electrode satisfies a condition "5 μm≦L≦120 μm" so as to keep the conductivity and ensure the transmittance of visual light from the discharge cells to outside. It is preferable that the width L of each line electrode satisfies a condition "10 μm≦L≦60 μm".

Each line electrode is a metal electrode. In the present embodiment, a metal thin film of Cr/Cu/Cr is used as the metal electrode. However, not limited to this, a metal thin film of Pt, Au, Ag, Al, Ni, Cr or the like may be used. Also, a thick-film electrode, which is formed by generating a thick-film paste by diffusing metal powder of Ag, Ag/Pd, Cu, Ni or the like onto an organic vehicle, applying the generated paste by a printing method or the like, and baking the applied paste, may be used. Alternatively, a thin film of a conductive oxide such as tin oxide or indium oxide may be used.

In the display area (an area containing the discharge cells), the line electrodes 191*a*–193*a* and line electrodes 191*b*–193*b* are respectively parallel to each other with a certain interval in between. Outside the display area, however, they are respectively connected to each other. The same driving waveform is applied to the three line electrodes in each set.

As shown in FIG. 12, a distance between the line electrodes 191*a* and 191*b* that are positioned innermost is referred to as a main discharge gap G. Also, a distance between the line electrodes 191*a* and 192*a* and a gap between the line electrodes 191*b* and 192*b* are referred to as a first electrode gap S1. Also, a distance between the line electrodes 192*a* and 193*a* and a distance between the line electrodes 192*b* and 193*b* are referred to as a second electrode gap S2.

Effects of Applying Sustain Pulse of Present Invention to PDP Having Split Electrode Structure The following is a description of the effects obtained by applying the sustain pulse having the characteristic waveform shown in FIG. 6 to the PDP having the split electrode structure.

First, the characteristics of the sustain discharge that is generated when the sustain pulse having a general rectangular waveform is used in the PDP having the split electrode structure will be described.

In the split electrode structure, compared with the case of non-split electrode structure, a small amount of reactive power is consumed, and thus the luminous efficiency is excellent.

The main reason why the split electrode structure provides an excellent luminous efficiency is that due to the gap between the line electrodes, the area of the electrodes is smaller than that of the transparent electrodes in the non-split electrode structure, making the capacitance of the capacitor smaller, and that as is the case with the transparent electrodes in the non-split electrode structure, the split electrode structure ensures a large light-emission area since the light-emission area expands from the innermost line electrode to the outermost line electrode. Also, the discharge moves slowly in the split electrode structure. It is considered that this is because each gap between the line electrodes 191*a*–193*a* has a low field intensity, while the main discharge gap has a high field intensity.

On the other hand, in the split electrode structure, the discharge moves more slowly than in the non-split electrode structure, and reduction in the terminal voltage of the panel is apt to happen when the discharge current is at a peak. If reduction in the terminal voltage of the panel happens when the discharge current is at a peak, the luminance or luminous efficiency or the recovery efficiency of the electricity recovery circuit tends to decrease.

In general, in the non-split electrode structure, the discharge current is apt to form a single peak when the sustain pulse is applied. In contrast, in the split electrode structure, it is rare that the discharge current forms a single peak when the sustain pulse is applied. Here, that "the discharge current forms a single peak" indicates that the discharge current has only one peak when a sustain pulse is applied, as shown in FIG. 5B (this includes a case where a peak has a "shoulder"). That "the discharge current does not form a single peak" indicates that the discharge current clearly has two or more peaks when a sustain pulse is applied.

When the discharge current has two or more peaks, the discharge delay time may increase and variation in the discharge delay time may increase.

In contrast, when the sustain pulse having the staircase waveform is applied to the split electrode structure, the discharge moves faster, and the discharge current is apt to form a single peak.

In the split electrode structure, whether the discharge current forms a single peak or not is basically determined by the arrangement of the line electrodes (pitch or gap between the line electrodes). More specifically, as will be explained in the following embodiment, the gap between the line electrodes may be set to decrease gradually as it goes away from the main discharge gap G toward the outermost line electrode. Also, it is possible to make an adjustment so that the discharge current forms a single peak by setting a condition that an average gap S being an average value of a distance between the line electrodes is represented as "G−60 μm≦S≦G+20 μm" (preferably "G−40 μm≦S≦G+10 μm").

Another example of a condition for facilitating the formation of a single peak is that inner line electrodes closer to the main discharge gap have small widths, and outer line electrodes have large widths.

A further example of a condition for facilitating the formation of a single peak is "Lave<Ln≦[0.35P−(L1+L2+ . . . +Ln−1)]" when there are n line electrodes, or "Lave+10 μm≦Ln≦[0.3P−(L1+L2+ . . . +Ln−1)]" where "P" represents a pixel pitch (vertical cell pitch), "Lave"

represents an average electrode width of the n line electrodes, and "Ln" represents the width of the outermost line electrode.

A further example of a condition for facilitating the formation of a single peak is that the width L1 of the innermost line electrode and the width L2 of the second-innermost line electrode satisfy the relationship "0.5 Lave<L1,L2≦Lave", preferably "0.6 Lave<L1, L2≦0.9Lave", with reference to the average electrode width "Lave".

It should be noted here that using the sustain pulse having a staircase waveform is very effective in causing the discharge current to have a single peak since it is difficult, in general, for the discharge current to have a single peak in the split electrode structure.

Another reason that is considered why it is difficult for the discharge current to have a single peak in the split electrode structure may be related to a form in which the discharge spreads, as discussed below.

FIGS. 13A–13E show how the light-emission area moves when a sustain pulse is applied to split electrodes. In FIGS. 13A–13E, it is supposed that a sustain pulse with a straight polarity is applied to the sustain electrode 19*b*, and that the sustain electrode 19*b* is on the anode side and the scanning electrode 19*a* is on the cathode side. The diagonally shaded areas in FIGS. 13A–13E indicate the light-emission areas.

Figure 13A:
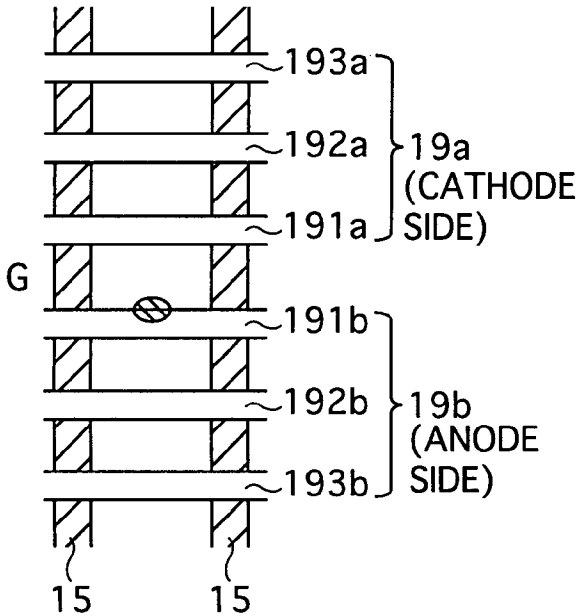
FIGS. 13A–13E show how the light-emission area moves when a sustain pulse is applied to split electrodes.
Figure 13B:
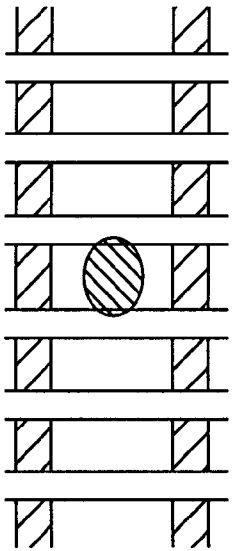
Figure 13C:
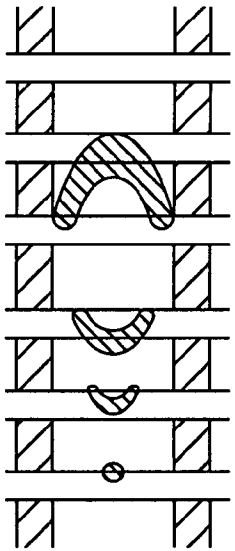

As shown in FIG. 13A, a light-emission area is generated (the discharge starts) in the vicinities of the main discharge gap (in the vicinities of the line electrode 191*b*). As shown in FIG. 13B, the light-emission area spreads over the main discharge gap. As shown in FIG. 13C, the light-emission area is divided into an anode-side light-emission area and a cathode-side light-emission area, where the anode-side light-emission area is further divided into a plurality of small parts, which are scattered over the line electrodes 191*b*–193*b* in stripes.

Figure 13D:
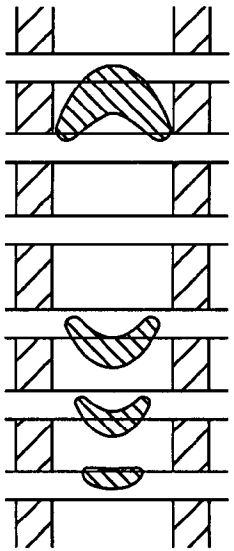
Figure 13E:
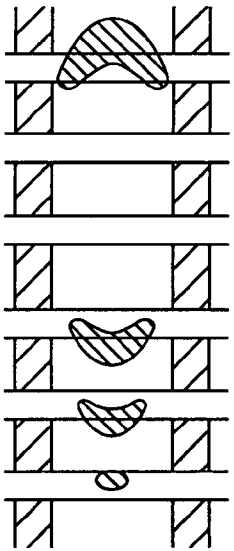

After this, as shown in FIGS. 13D–13E, while the anode-side light-emission areas do not move, the cathode-side light-emission area (considered to be a light-emission area by the negative glow) moves from the line electrode 191*a* to the line electrode 193*a*.

As described above, Embodiment 2 basically provides similar effects to those provided by Embodiment 1, due to the application of the sustain pulse having the staircase waveform to the split electrode structure. In addition, however, Embodiment 2 provides a unique effect of facilitating the formation of a single peak in the discharge current, which is generally difficult in the split electrode structure. This is because the power is entered intensively in the second period including the point t5 at which the discharge current is at the maximum.

Also, as understood from the discharge current waveform in an embodiment that will be described later, the shape of the discharge light-emission peak becomes sharp, and the discharge ends in a short time.

Since the shape of the discharge light-emission peak becomes sharp and the discharge ends in a short time, a half discharge peak width T hw is observed to be in a range "30 ns≦T hw≦1.0 μs", or "40 ns≦T hw≦500 ns", or "50 ns≦T hw≦1.0 μs", or "70 ns≦T hw≦700 ns".

Also, the application of the sustain pulse having the staircase waveform to the split electrode structure provides an effect of increasing the speed of electrons when the discharge plasma grows since a high voltage is applied during the second period, and thus an effect of improving Xe excitation efficiency.

As a result, the application of the sustain pulse having the staircase waveform to the split electrode structure provides both of: an effect of improving the luminous efficiency that is ascribable to the split electrode structure; and effects of improving the luminous efficiency and shortening the pulse width that are ascribable to the formation of a single peak in the discharge current.

In regard with the rise start point t2 in the second step, as is the case with Embodiment 1, it is preferable in the present embodiment that the length of the first period T1 is set to be shorter than the discharge delay time Tdf. However, the same effects are obtained if the length of the first period T1 is close to the discharge delay time (that is, not larger than "discharge delay time Tdf+0.2 μsec")

It is also possible to explain, with reference to the Lissajous's figure shown in FIG. 7, the improvement in the luminous efficiency that is provided by the application of the sustain pulse having the staircase waveform to a PDP having the split electrode structure.

In FIG. 7, the loop "c" represents a case where the above-described staircase waveform is applied to the PDP having the split electrode structure.

The loop "c" is a narrow parallelogram like the loop "b", and it indicates that the amount of power consumption is small as much. The loop "b" has arc-shaped sides, while the loop "c" has straight sides.

The curved portions of a loop are apt to correspond to heat losses (the shaded parts in FIG. 7 indicate the heat loses). The heat is lost when the semiconductor used in the driving circuit generates heat. As the temperature at the semiconductor increases, the electric current also increases. This further spurs the heat loss. In contrast, when a loop is composed of straight lines as in the loop "c", the driving circuit is resistant to heat loss.

Accordingly, the loop "c" indicates a higher efficiency of the whole apparatus including the driving circuit than that indicated by the loop "b" since the loop "c" indicates less power consumption than that indicated by the loop "b".

Variations of Split Electrodes, T-Shaped Electrodes

It was explained earlier that the scanning electrode and the sustain electrode are each composed of three line electrodes that are connected to each other outside the display area. However, the same effects are obtained if connection units are disposed in the gaps between the three line electrodes at random to connect the line electrodes to each other in the display area.

Figure 14A:
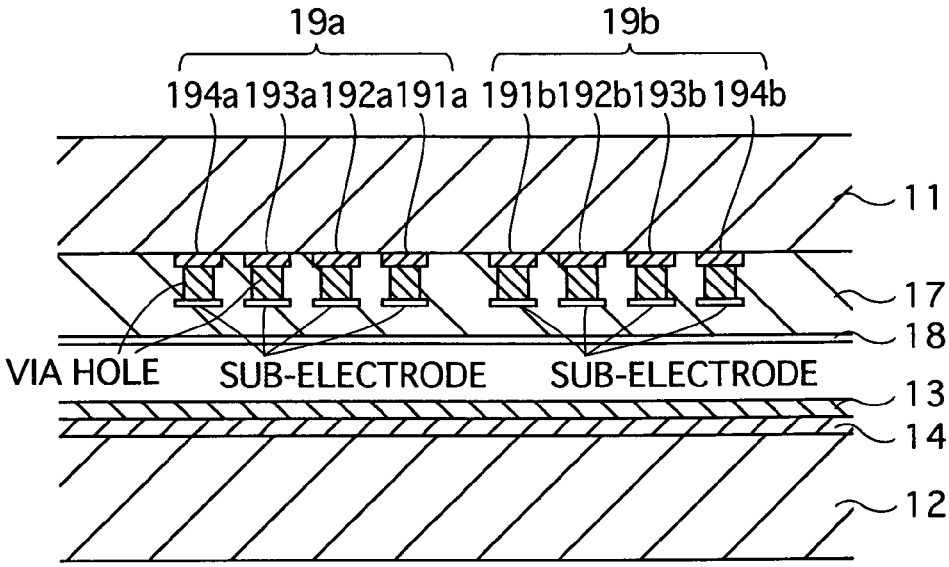
FIGS. 14A and 14B are a sectional view of a variation of the PDP having the split electrode structure, and a plan view of the electrode structure thereof, respectively.

FIG. 14A is a sectional view of another variation of the PDP having the split electrode structure.

In the example shown in FIG. 12, each line electrode is a simple straight line. On the other hand, in the PDP shown in FIG. 14A, sub-electrodes are connected to line electrodes 191*a*–194*a* and 191*b*–194*b* on a one-to-one basis.

Each sub-electrode extends along a line electrode, is disposed on the discharge-space side in the discharge cells, and is connected to a line electrode via a via hole.

Figure 14B:
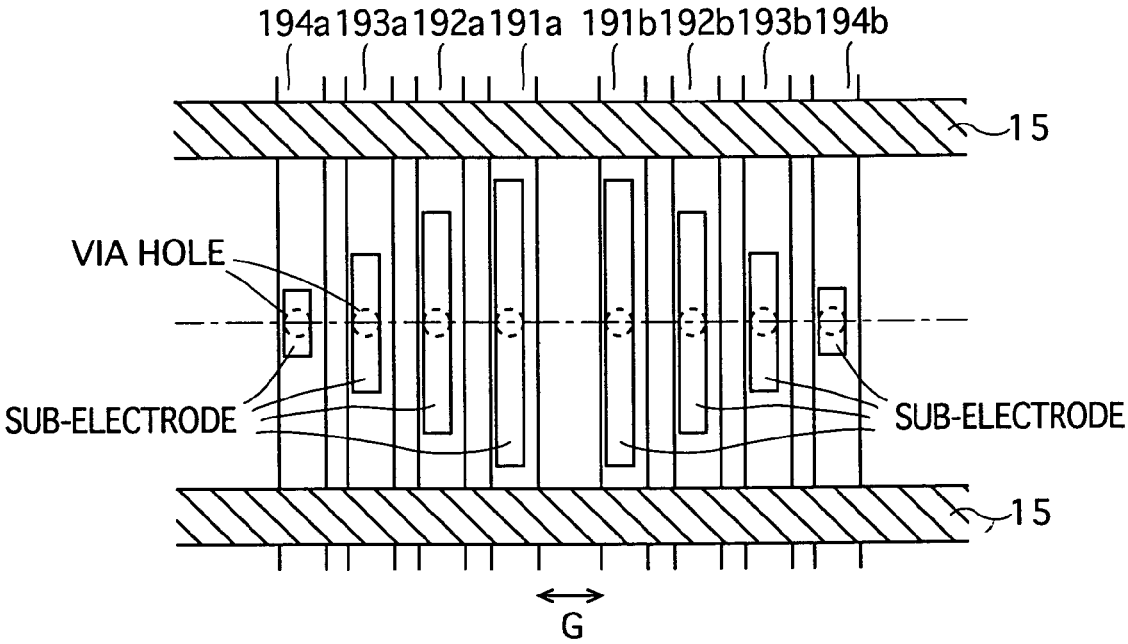
Figure 15A:
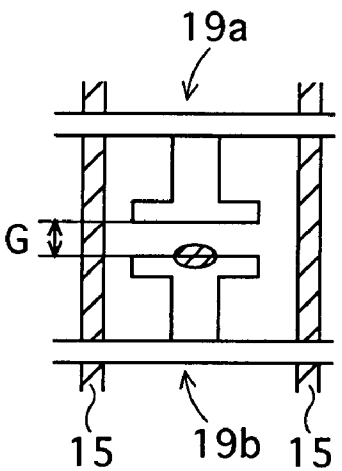
FIGS. 15A–15E show the movement of light-emission areas during discharge in a PDP that has electrodes on which projections are formed.
Figure 15B:
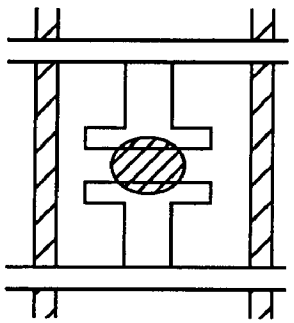
Figure 15C:
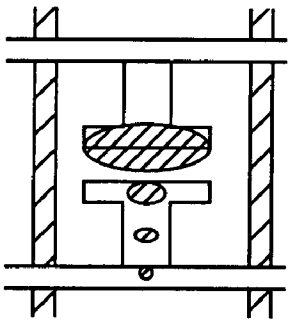
Figure 15D:
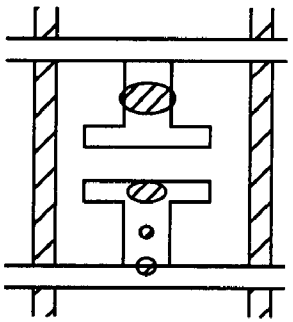
Figure 15E:
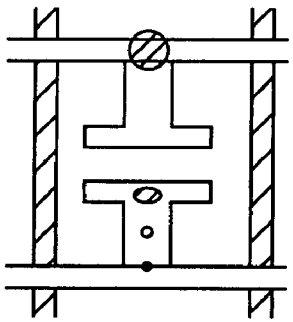

FIG. 14*b* is a plan view of the electrode structure of the front substrate shown in FIG. 14*a*, viewed from the discharge space side. As shown in FIG. 14*b*, each sub-electrode is strip-shaped and extends along the line electrodes. The sub-electrodes close to the main discharge gap G are longer than those close to the outside. The via holes are cylindrical. Not only the line electrodes, but the via holes and the sub-electrodes are covered with the dielectric layer 17.

The line electrodes, sub-electrodes, and via holes may be formed by a transparent electrode material (a metal oxide such as ITO) or a metal.

In the case of such an electrode structure in which the sub-electrodes are disposed on a discharge space side, the sub-electrodes are involved in the discharge, and the discharge spreads over the area in which the sub-electrodes exist.

Meanwhile, the split electrode structure generally has a tendency that the discharge in the vicinities of the main discharge gap emits light by excitation, while the spread discharge near the outside does not emit light by excitation. It is considered however that if the sub-electrodes closer to the outside are shorter as described above, the sub-electrodes involved in the discharge are shorter as they are closer to the outside, increasing the discharge density near the outside, thus facilitating the excitation light emission by the spread discharge near the outside.

There are other electrode structures that show discharge characteristics similar to the split electrode structure, as follows.

FIGS. 15A–15E show the movement of light-emission areas during discharge in a PDP that has electrodes on which projections are formed.

In the example shown in FIGS. 15A–15E, a scanning electrode 19*a* and a sustain electrode 19*b* in a pair have projections that face each other in a discharge cell. The projections are T-shaped, and are relatively narrow at the basal portions and wide at the tips.

In the case of an electrode structure having projections with such a shape, the luminous efficiency increases as the amount of reactive power is reduced, compared with the non-split electrode structure. On the other hand, as shown in FIGS. 15A–15E, the movement of the light-emission areas has a tendency similar to that of the split electrode structure shown in FIGS. 13A–13E, indicating that the discharge moves slowly.

Accordingly, it is expected that a PDP having such projection-formed electrodes provides the same effects as a PDP with the split electrode structure if the staircase waveform is applied to the sustain pulse.

Figure 16:
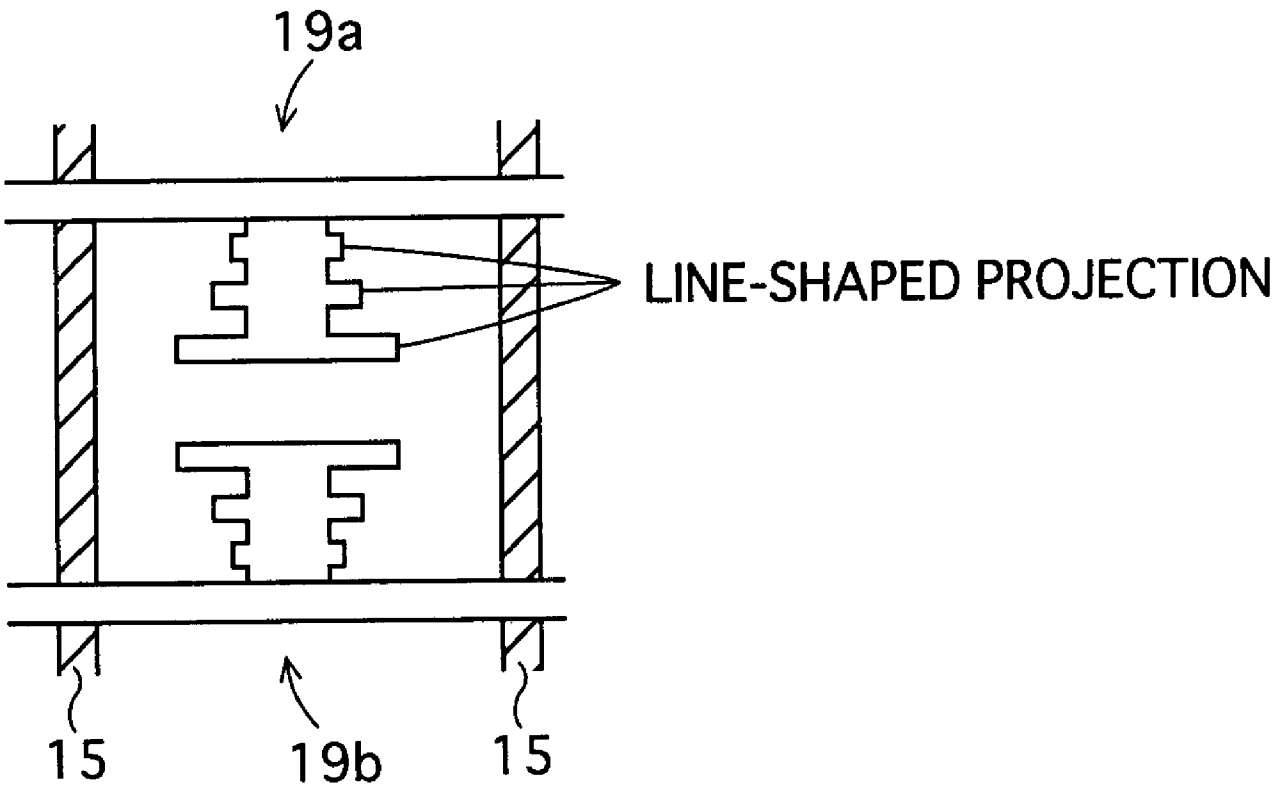
FIG. 16 shows a variation of an electrode structure in which projections are formed.

FIG. 16 shows a variation in which, as is the case with the example shown in FIGS. 15A–15E, a scanning electrode 19*a* and a sustain electrode 19*b* in a pair have projections that face each other in a discharge cell and are relatively narrow at the basal portions, but, different from the example shown in FIGS. 15A–15E, a plurality of line-shaped projections further extend in parallel from each projection along the electrodes, being somewhat similar to the split electrode structure.

It is expected that a PDP having such a structure shown in FIG. 16 provides the same effects as a PDP with the split electrode structure if the staircase waveform is applied to the sustain pulse.

Auxiliary Ribs

As will be described in Example 6, it is preferable that to prevent erroneous discharge, which is apt to happen due to cross talks when the distance between cells being adjacent in a vertical direction (the direction that the stripe ribs 15 extend) is no larger than 300 μm, auxiliary ribs are formed in spaces between vertically adjacent stripe ribs to divide the discharge cells.

It is preferable that the width of the top of the auxiliary ribs ranges from 30 μm to 600 μm inclusive, more preferably, from 50 μm to 450 μm inclusive.

It is also preferable that the height "h" of the auxiliary ribs ranges from 40 μm to the height "H" of the stripe ribs 15 inclusive, more preferably, from 60 μm to (H−10) μm inclusive.

Application to Writing

The above-described driving waveform is also applicable to the scanning pulse or write pulse, as well as to the sustain pulse. With such an application of the driving waveform, the discharge current forms a single peak during a writing and ends quickly. This shortens the discharge delay, achieving a high-speed writing.

This will be described in more detail. It is known that in general, if the discharge probability of the write discharge lowers during the write period while a PDP is displaying an image, the image quality is degraded by a flickering or a grainy screen. The grainy screen becomes distinct when the discharge probability in the write period becomes lower than 99.9%, and a flickering occurs when the discharge probability becomes lower than 99%.

To prevent the occurrence of the above phenomena, it is necessary to restrict the occurrence of write defects to less than 0.1%. To achieve this, an average discharge delay should approximately be ⅓, the width of the write pulse.

For a panel definition level of the NTSC or VGA (Video Graphic Array) that require 500 or the like of scanning lines, 2–3 μs of the write pulse width is enough for driving. However, for the SXGA (Super extended Graphics Array) or a full-spec high-definition TV that require 1,080 scanning lines, the writing should be performed at a high speed where the write pulse width is approximately 1–1.3 μs.

In the case where the split electrode structure is adopted and a plurality of peaks are generated, it is difficult to achieve a high-speed writing using ordinary scanning or write pulse waveform. However, a high-speed writing can be achieved by using the waveform described in the present embodiment to form a single discharge peak.

Others

The present embodiment describes a case where the discharge current forms a single peak. However, the present embodiment may be modified for a case where the discharge current forms a plurality of peaks due to the electrode structure. That is to say, the sustain pulse may have a plurality of second periods in correspondence with positions of a plurality of peaks in the discharge current. With this arrangement, a high-level voltage V2 is applied in correspondence with the plurality of peaks appearing in the discharge current. This provides an effect of improving the luminous efficiency.

The description of Embodiments 1 and 2 is based on a surface-discharge type AC plasma display panel being used as an example. However, the above-described waveform can also be applied to the sustain pulse of an opposed-discharge type AC plasma display panel, and the same effects can be obtained. Furthermore, the above-described waveform can also be applied to the sustain pulse of a DC plasma display panel, and the same effects can be obtained.

The following describes Examples 1–8 of the above-described embodiments.

EXAMPLE 1

Example 1 is a PDP with the split electrode structure described in Embodiment 2, and is set as follows: the pixel pitch P=1.08 mm; the main discharge gap G=80 μm; electrode width (L1, L2, L3)=40 μm; and the first electrode gap S1=the second electrode gap S2=70 μm.

Also, in Example 1, a sustain pulse having two rise steps is used when the PDP is driven.

Figure 17A:
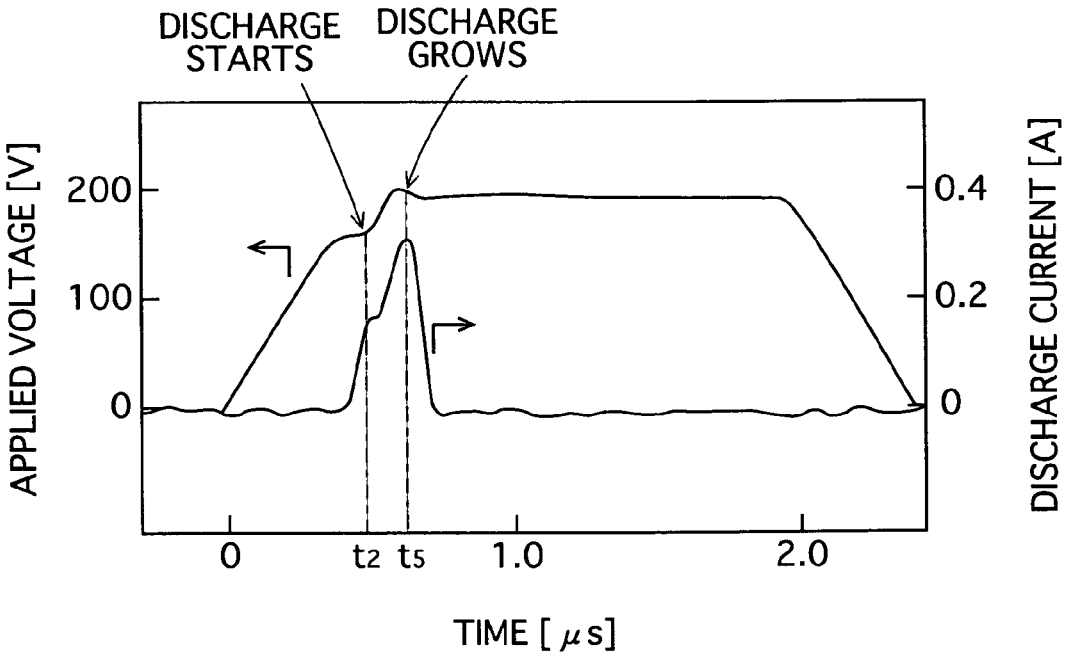
FIGS. 17A and 17B show waveforms of the sustain pulse and the discharge current in Example 1 and a comparative example.
Figure 17B:
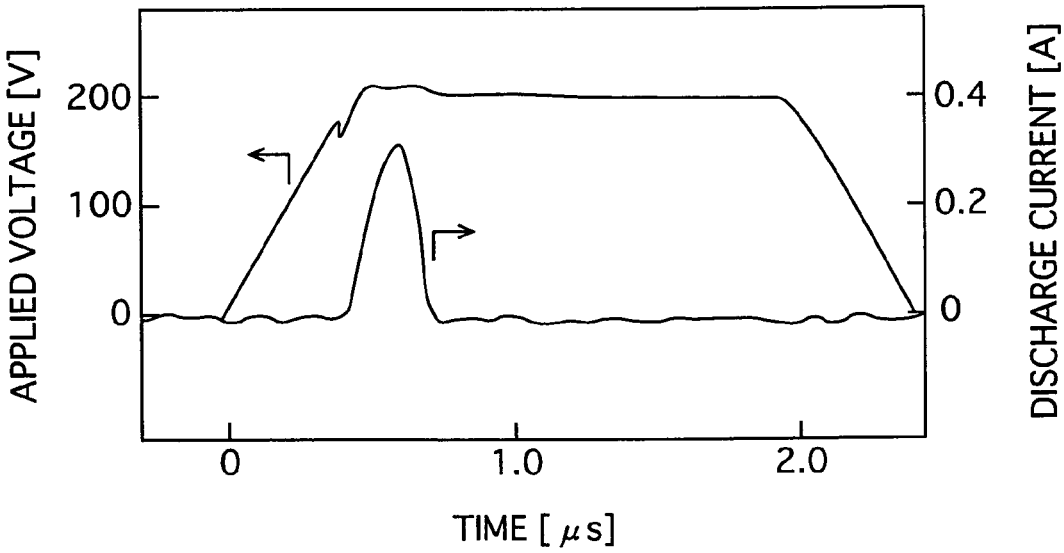

FIG. 17A shows the waveform of the sustain pulse and the waveform of the discharge current that is generated when the sustain pulse is applied. As shown in FIG. 17A, the rise start point t2 of the second step precedes the point t5 at which the discharge current is at the maximum. FIG. 17B shows the waveforms of the sustain pulse and the discharge current of a comparative example which is a PDP having the same construction as Example 1 but is different in that the sustain pulse has a simple rectangular waveform.

As shown in FIG. 17B: the discharge current waveform has a single peak; the discharge light emission ends within 1 μs since the start of the pulse application; and the discharge delay is as short as 0.5 μs to 0.7 μs. This suggests that a high-speed driving is possible with several microseconds of the sustain pulse width by setting the pitch or gap between the line electrodes as described above so that the discharge current waveform has a single peak.

In FIG. 17A, compared with FIG. 17B, the discharge current rises to a high level through two steps, and the discharge current immediately after the discharge start is much suppressed compared with the discharge current at the maximum. This indicates that a greater part of the power from the driving circuit is used by the discharge cells when the discharge current grows.

Figure 18:
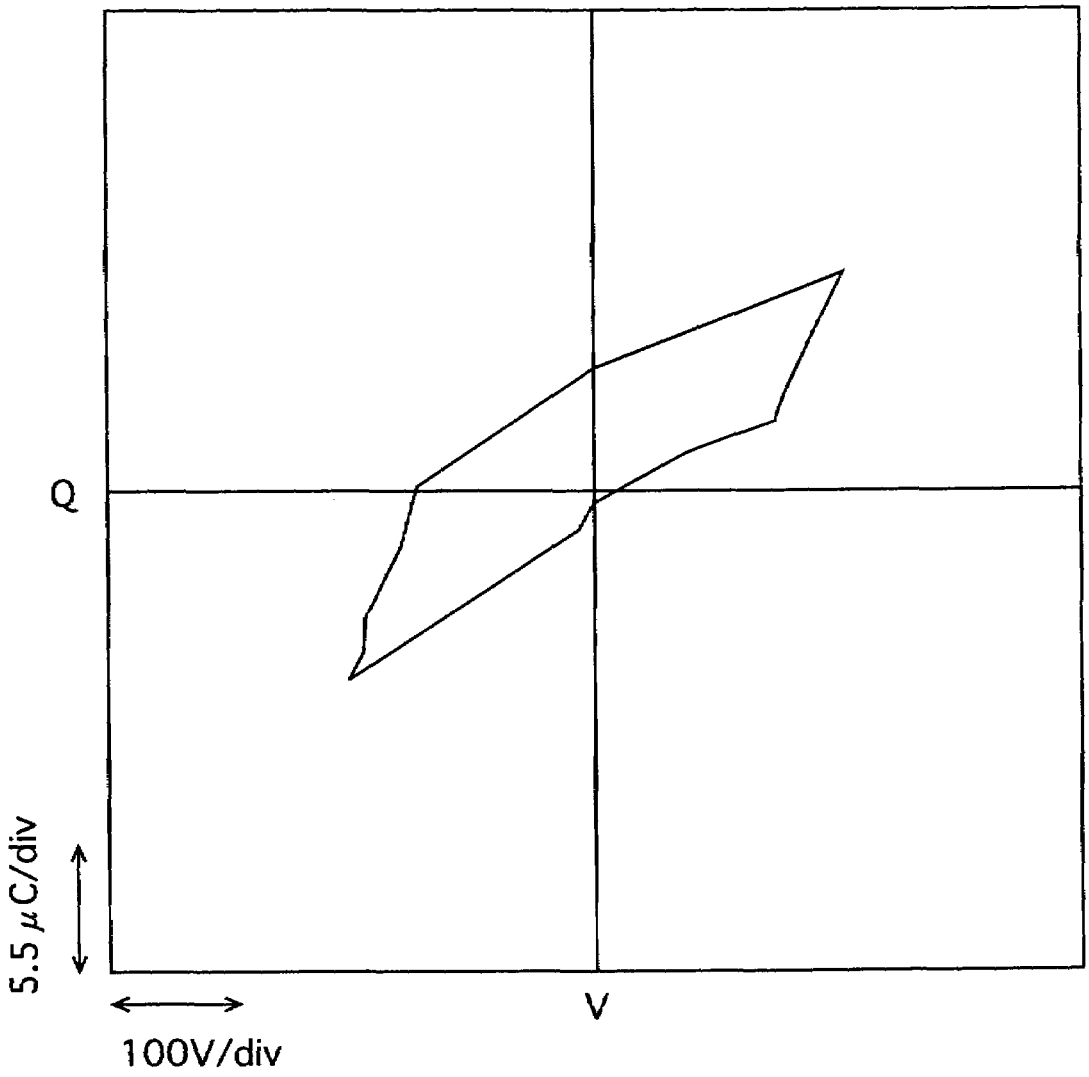
FIG. 18 is a V-Q Lissajous's figure of Example 1.

FIG. 18 is a V-Q Lissajous's figure of Example 1. The loop in FIG. 18 is a narrow, distorted parallelogram like the loop "c" shown in FIG. 7. Also, a similarly distorted parallelogram was obtained as the loop of the V-Q Lissajous's figure when the voltage V1 for the first period was varied within a range satisfying "Vf−20V≦V1≦Vf+30V", and the time period between the rise start point t1 of the first step and the rise start point t2 of the second step was varied within a range of (discharge delay time Tdf−0.2 μsec) to (Tdf+0.2 μsec) inclusive.

Then, Example 1, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 1 shows the comparison results.

TABLE 1

| | Relative luminance B | Relative power consumption W | Relative luminous efficiency η |
|---|---|---|---|
| Simple rectangular wave | 1.00 | 1.00 | 1.00 |
| Waveform of Example 1 | 1.30 | 1.15 | 1.13 |

As shown in Table 1, compared to the comparative example, Example 1's waveform increases the luminance by approximately 30%, but compared to this, the increase in power consumption has been suppressed to approximately 15%, and Example 1's waveform also increases the light emission efficiency by approximately 13%.

It is accordingly understood that the PDP display apparatus of Example 1 greatly increases the luminance, suppresses the increase in the power consumption, and therefore achieves a high-quality screen with a high luminance.

In Example 1, the sustain pulse has a staircase waveform in the rise stage. However, similar, excellent advantageous effects can be obtained by setting the sustain pulse to have a staircase waveform both in the rise and fall stages.

Also, the dimension of the discharge cells is not limited to the above typical one, but may be varied to satisfy the following conditions to obtain the same effects: 0.5 mm≦P≦1.4 mm; 60 μm≦G≦140 μm; 10 μm≦L1, L2, L3≦60 μm; 30 μm≦S≦G, where "S" represents an average gap between line electrodes.

Also, the gaps between line electrodes may be uneven. In this case too, excellent advantageous effects similar to those of the present embodiments can be obtained if the gaps between the electrodes are even.

EXAMPLE 2

Figure 19:
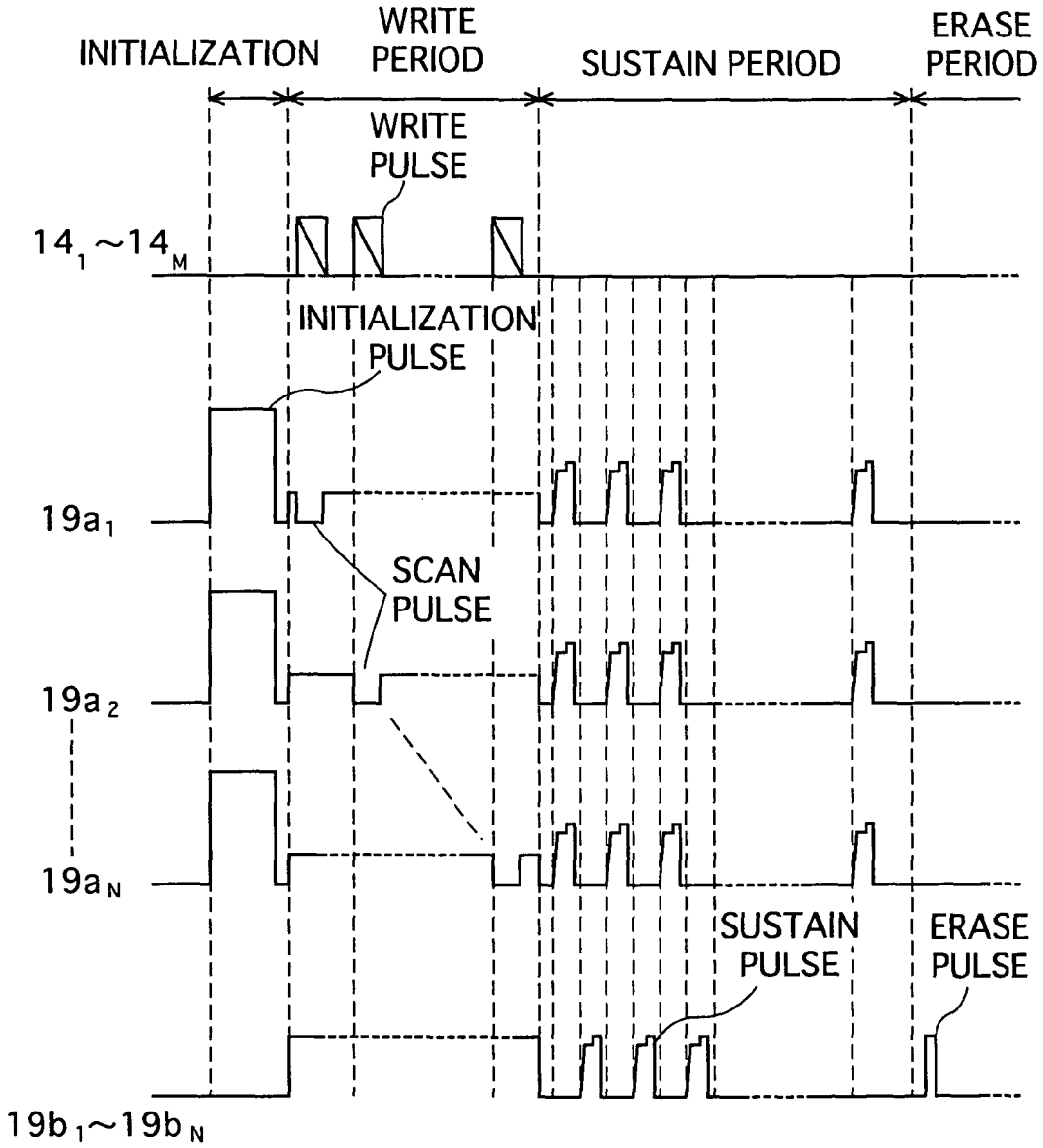
FIG. 19 is a timing chart of a driving waveform of Example 2.

FIG. 19 is a timing chart of a driving waveform of Example 2.

Example 2 is a PDP having the same construction as Example 1 but is different in the waveform of the sustain pulse. That is to say, the sustain pulse of Example 2 has two rise steps that have different inclinations.

Figure 20:
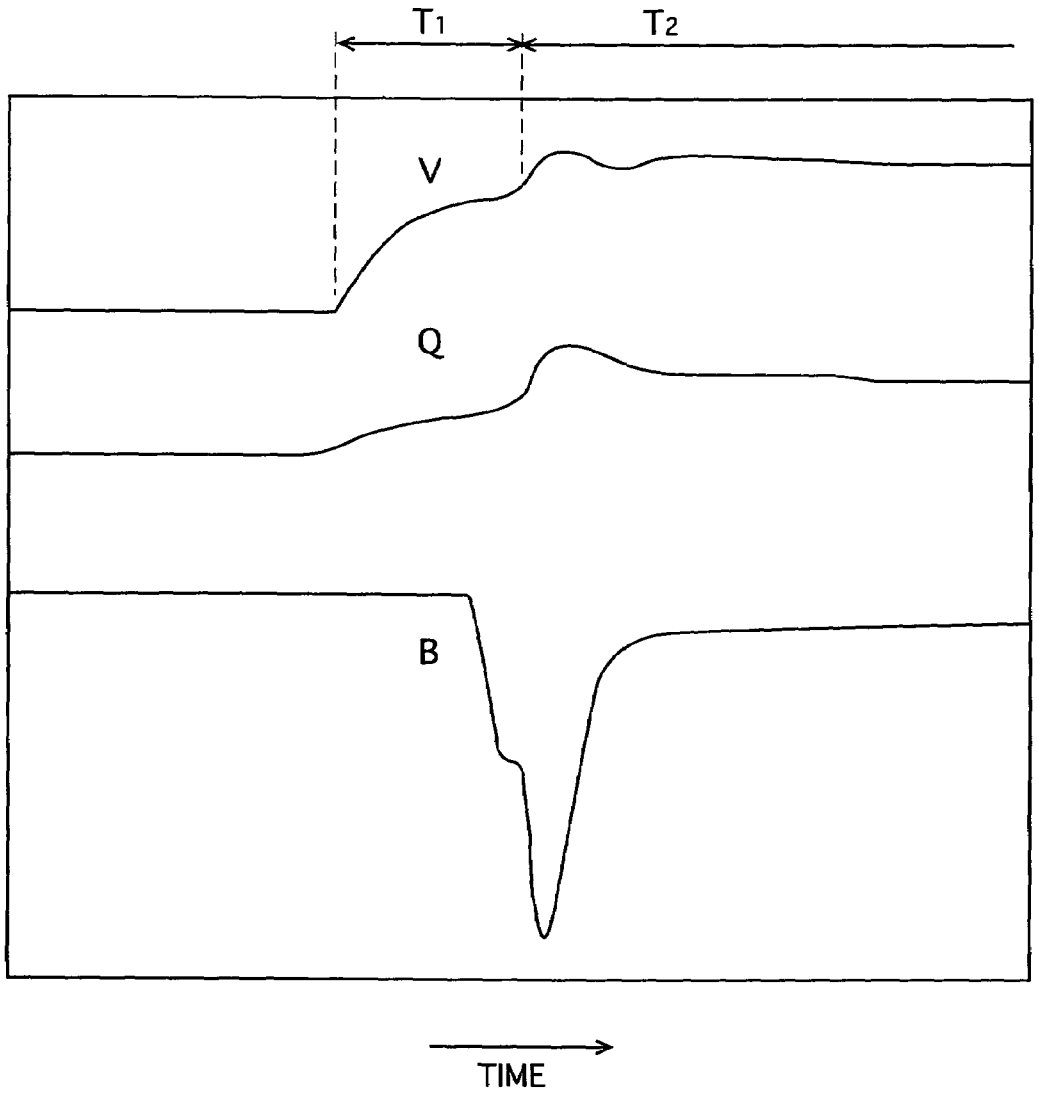
FIG. 20 shows a voltage V between electrodes, an amount Q of charges accumulated in the discharge cells, and an amount B of light emission in the PDP of Example 2.

FIG. 20 shows change in properties of Example 2 PDP with time, where "V" represents a voltage between electrodes in discharge cells, "Q" an amount of charges accumulated in the discharge cells, and "B" an amount of light emission. As indicated by the inter-electrode voltage V shown in FIG. 20, the rise inclination (rate of voltage rise) of the second period T2 is set to be larger than that of the first period T1 in Example 2.

FIG. 20 indicates that the peak in the light-emission peak waveform (a point in time at which the discharge current is at the maximum) approximately corresponds to the largest inclination of the voltage V rise and to a point at which the voltage V is at the maximum.

Figure 21:
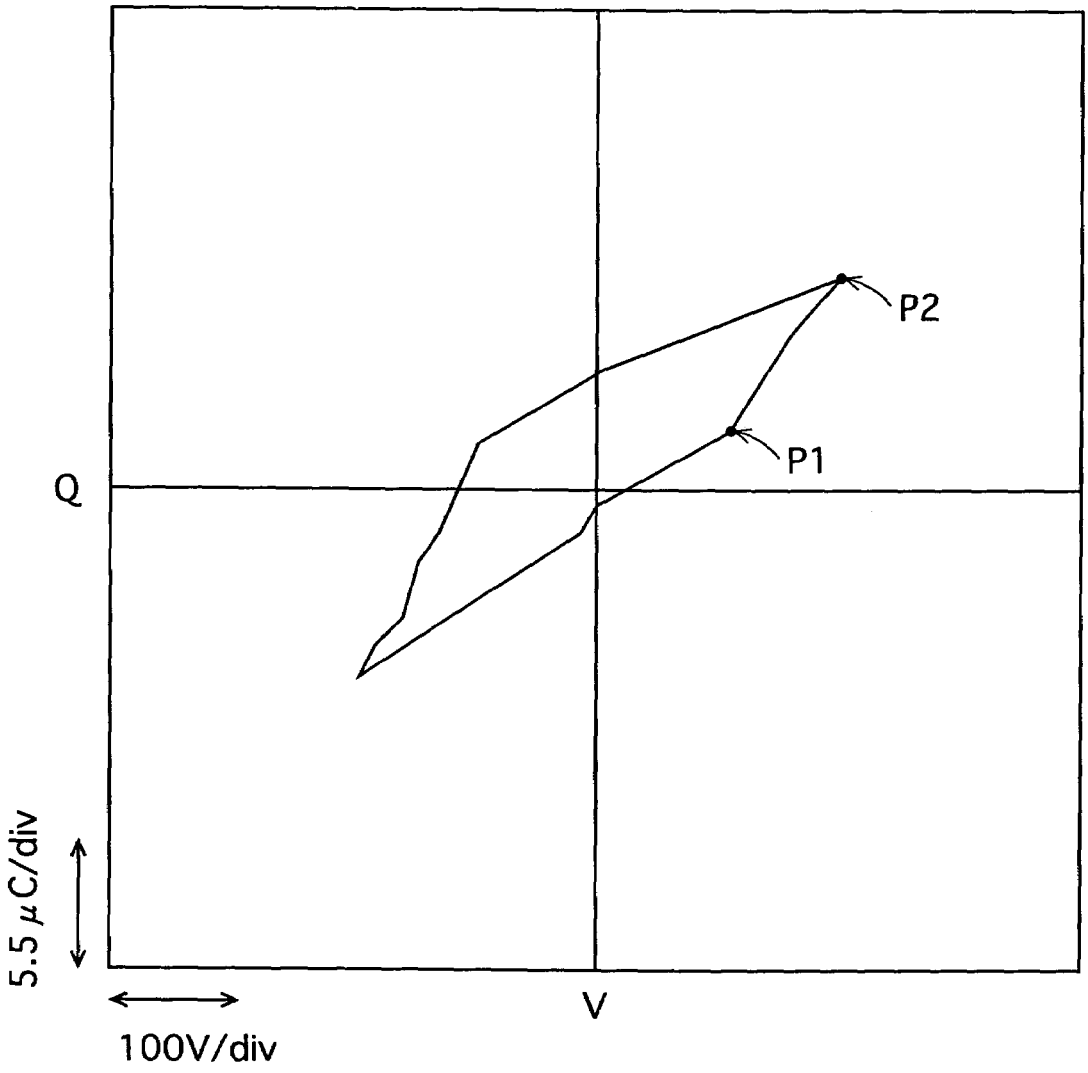
FIG. 21 is a V-Q Lissajous's figure of Example 2.

FIG. 21 is a V-Q Lissajous's figure of Example 2. The loop in FIG. 21 is a narrow, distorted parallelogram. FIG. 21 indicates that the area of the loop is greatly restricted compared with the amount of moved charges (ΔQ) in the discharge cells since the discharge start voltage (P1) is lower than the discharge end voltage (P2) which is measured after the charges have moved.

Then, Example 2, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 2 shows the comparison results.

TABLE 2

| | Relative luminance B | Relative power consumption W | Relative luminous efficiency η |
|---|---|---|---|
| Simple rectangular wave | 1.00 | 1.00 | 1.00 |
| Waveform of Example 2 | 1.25 | 1.09 | 1.15 |

As shown in Table 2, compared to the comparative example, Example 2's waveform increases the luminance, but compared to this, the increase in power consumption is relatively small, and Example 2's waveform also increases the light emission efficiency by approximately 15%.

This indicates that the PDP display apparatus of Example 2, in which a staircase waveform having two steps with different inclinations is used in the sustain pulse, greatly increases the luminance while suppressing the increase in the power consumption, and therefore achieves a high-quality screen with a high luminance.

In Example 2, a staircase waveform having two rise steps with different inclinations is used for the sustain pulse. However, an excellent image quality can be achieved if a staircase waveform having two steps with different inclinations in each of the rise and fall is used for the sustain pulse (that is to say, a third period T3 of a low-level voltage V3 is set to follow the second period T2, and the fall inclination of the third period is set to be smaller than that of the second period).

EXAMPLE 3

Figure 22:
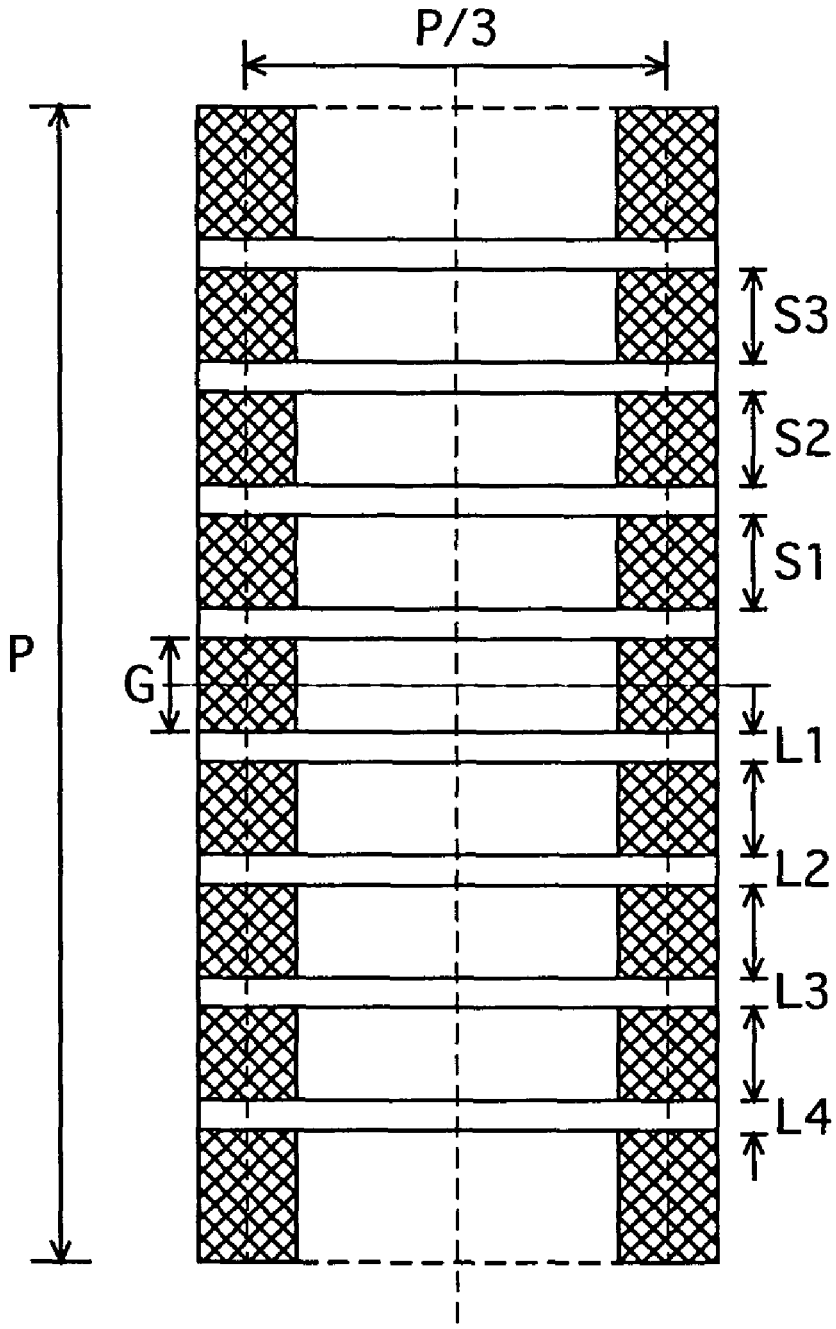
FIG. 22 shows an electrode pattern of Example 3.

FIG. 22 shows an electrode pattern of Example 3.

Example 3 is a PDP in which each scanning and sustain electrode is divided into four line electrodes.

A typical dimension of the discharge cell is as follows: the pixel pitch P=1.08 mm; the main discharge gap G=80 μm; electrode width (L1, L2, L3, L4)=40 μm; and the first electrode gap S1=the second electrode gap S2=the third electrode gap S3=70 μm.

Also, as is the case with Example 1, in Example 3, a sustain pulse having two rise steps is used when the PDP is driven.

Figure 23A:
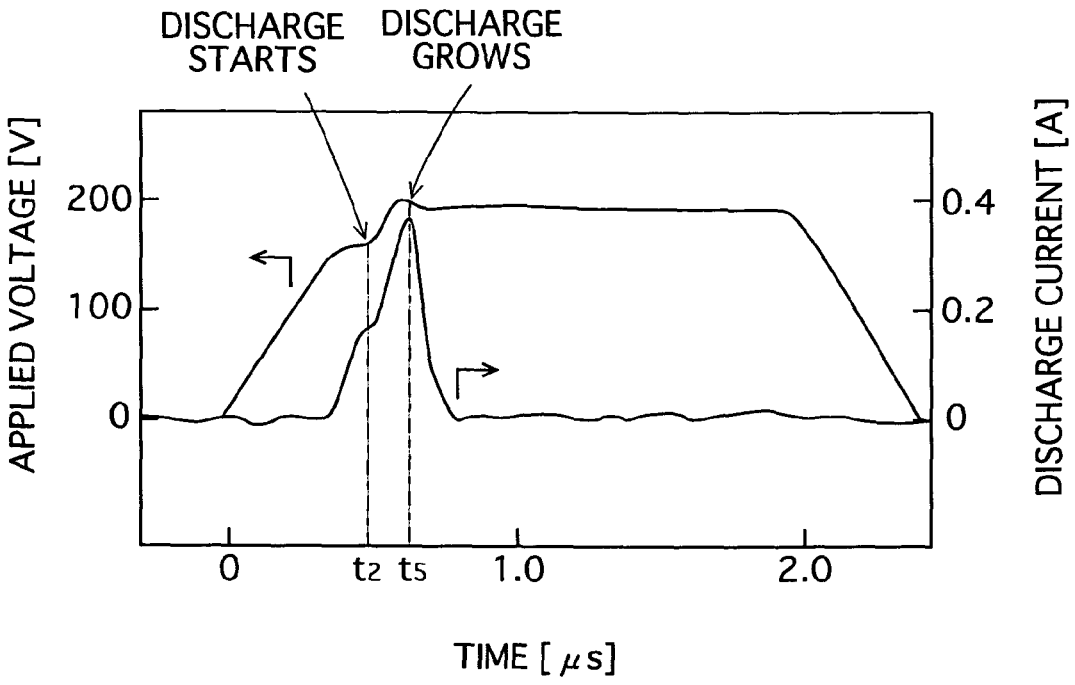
FIGS. 23A and 23B show waveforms of the sustain pulse and the discharge current in Example 3 and a comparative example.
Figure 23B:
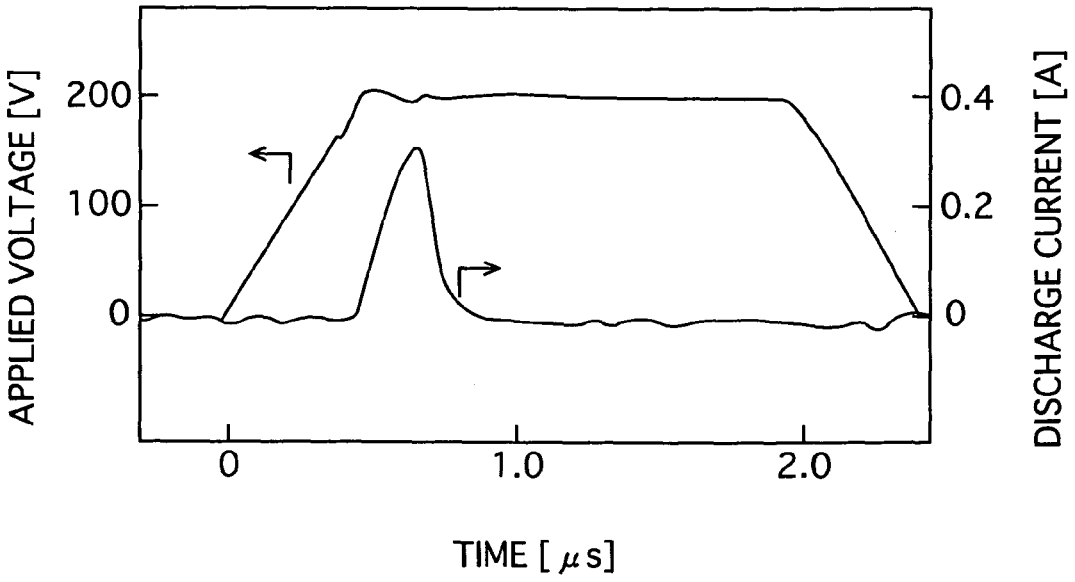

FIG. 23A shows the waveform of the sustain pulse and the waveform of the discharge current that is generated when the sustain pulse is applied. As shown in FIG. 23A, the rise start point t2 of the second step precedes the point t5 at which the discharge current is at the maximum. FIG. 23B shows the waveforms of the sustain pulse and the discharge current of a comparative example which is a PDP having the same construction as Example 3 but is different in that the sustain pulse has a simple rectangular waveform.

As shown in FIG. 23B: the discharge current waveform has a single peak; the discharge light emission ends within 0.9 μs since the start of the pulse application; and the discharge delay is as short as approximately 0.6 μs. The reason why the discharge current waveform has a single peak is considered that when the electrode gap is as narrow as 70 μm, the discharge plasma is apt to expand to the outmost electrode, allowing the discharge to continue as much.

This suggests that a high-speed driving is possible with several microseconds of the sustain pulse width by setting the pitch or gap between the line electrodes as described above so that the discharge current waveform has a single peak.

In FIG. 23A, compared with FIG. 23B, the discharge current rises to a high level through two steps, and the discharge current immediately after the discharge start is much suppressed compared with the discharge current at the maximum. This indicates that a greater part of the power from the driving circuit is used by the discharge cells when the discharge current grows.

Then, Example 3, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 3 shows the comparison results.

TABLE 3

| | Relative luminance B | Relative power consumption W | Relative luminous efficiency η |
|---|---|---|---|
| Simple rectangular wave | 1.00 | 1.00 | 1.00 |
| Waveform of Example 3 | 1.65 | 1.39 | 1.19 |

As shown in Table 3, compared to the comparative example, Example 3's waveform increases the luminance by approximately 65%, but compared to this, the increase in power consumption has been suppressed to approximately 39%, and Example 3's waveform also increases the light emission efficiency by approximately 19%.

This indicates that using a staircase waveform having two rise steps for the sustain pulse, as in Example 3, greatly increases the luminance while suppressing the increase in the power consumption, and therefore achieves a PDP with a high-image-quality and a high luminance.

In Example 3, the sustain pulse has a staircase waveform in the rise stage. However, similar, excellent advantageous effects can be obtained by setting the sustain pulse to have a staircase waveform both in the rise and fall stages.

Also, the dimension of the discharge cells is not limited to the above typical one, but may be varied to satisfy the following conditions to obtain the same effects: 0.5 mm≦P≦1.4 mm; 60 μm≦G≦140 μm; 10 μm≦L1, L2, L3, L4≦60 μm; 30 μm≦S≦G, where "S" represents an average gap between line electrodes.

EXAMPLE 4

Figure 24:
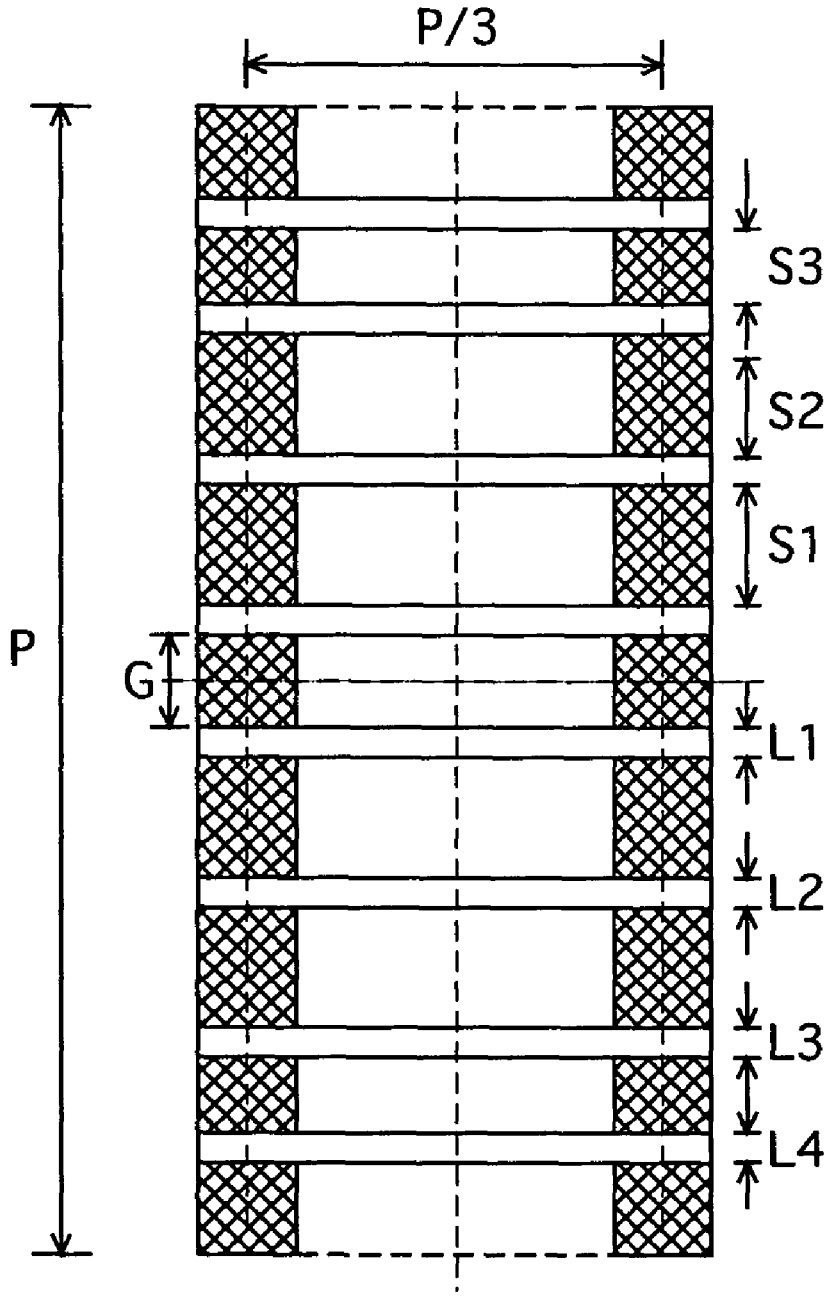
FIG. 24 shows an electrode pattern of Example 4.

FIG. 24 shows an electrode pattern of Example 4.

Example 4 is a PDP in which, for each scanning and sustain electrode, the gap between the line electrodes is set to decrease arithmetically (electrode gap difference ΔS) as it goes away from the main discharge gap G toward the outermost line electrode, and the main discharge gap at the center of the cell is large.

The expansion of the distribution of the electric field intensity toward outside the sustain electrode and the expansion of the main discharge gap at the center of the cell cause the discharge plasma to expand toward outside the sustain electrode and improves the visible light extraction efficiency.

A typical dimension of the discharge cell is as follows: the pixel pitch P=1.08 mm; the main discharge gap G=80 μm; electrode width (L1, L2)=35 μm; L3=45 μm; L4=45 μm; the first electrode gap S1=90 μm; the second electrode gap S2=70 μm; and the third electrode gap S3=50 μm (electrode gap difference ΔS=20 μm).

Also, as is the case with Example 1, in Example 4, a sustain pulse having two rise steps is used when the PDP is driven.

Figure 25A:
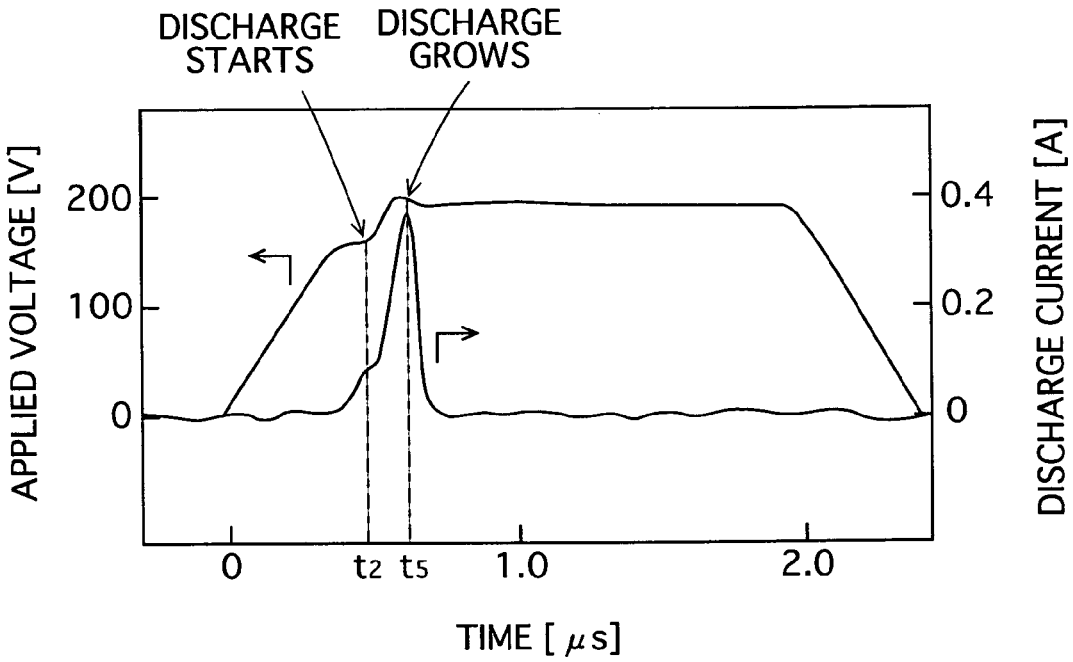
FIGS. 25A and 25B show waveforms of the sustain pulse and the discharge current in Example 4 and a comparative example.
Figure 25B:
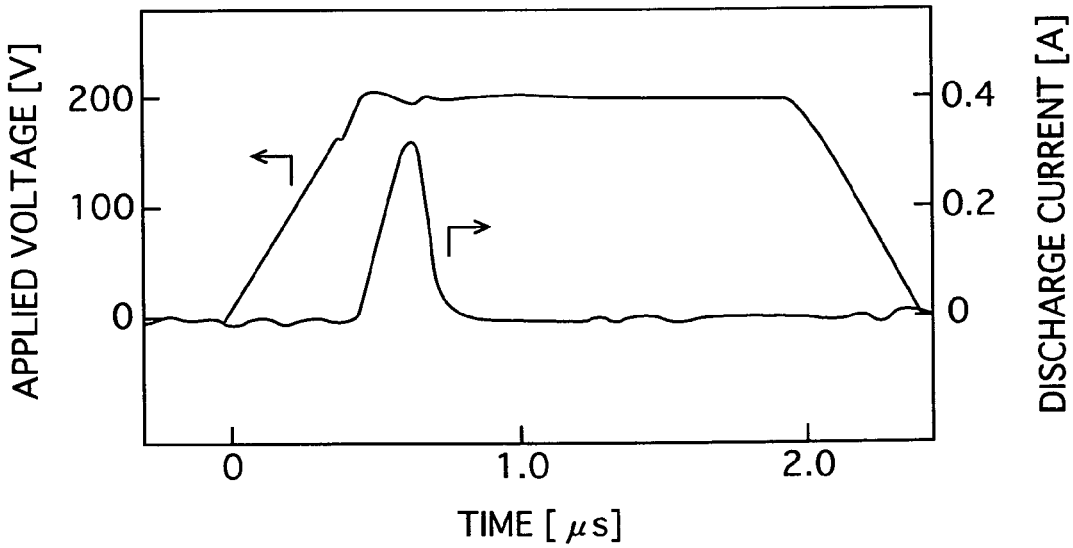

FIG. 25A shows the waveform of the sustain pulse and the waveform of the discharge current that is generated when the sustain pulse is applied. As shown in FIG. 25A, the rise start point t2 of the second step precedes the point t5 at which the discharge current is at the maximum. FIG. 25B shows the waveforms of the sustain pulse and the discharge current of a comparative example which is a PDP having the same construction as Example 4 but is different in that the sustain pulse has a simple rectangular waveform.

As shown in FIG. 25B: the discharge current waveform has a single peak; the discharge light emission ends within 0.8 μs since the start of the pulse application; and the discharge delay is as short as approximately 0.6 μs.

The reason why the discharge current waveform has a single peak is considered that the setting of the gap between the line electrodes to decrease gradually as it goes away from the main discharge gap has caused the discharge plasma to be apt to quickly expand to the outmost electrode.

In FIG. 25A, compared with FIG. 25B, the discharge current rises to a high level through two steps, and the discharge current immediately after the discharge start is suppressed, to ⅓ the discharge current at the maximum. This indicates that a greater part of the power from the driving circuit is used by the discharge cells when the discharge current grows.

Then, Example 4, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 4 shows the comparison results. Note that Table 4 also shows the measurement results for Example 3, together with the half breadth values measured for Examples 3 and 4.

TABLE 4

| | Relative luminance B | Relative power consumption W | Relative luminous efficiency η | Half width [ns] |
|---|---|---|---|---|
| Simple rectangular wave | 1.00 | 1.00 | 1.00 | — |
| Waveform of Example 3 | 1.65 | 1.39 | 1.19 | 240 |
| Waveform of Example 4 | 1.72 | 1.45 | 1.19 | 160 |

As shown in Table 4, Example 4's waveform is approximately 1.7 times the comparative example in the luminance, but compared to this, the increase in power consumption is relatively small, and Example 4's waveform also increases the light emission efficiency by approximately 20%.

This indicates that using a staircase waveform having two rise steps for the sustain pulse, as in Example 4, greatly increases the luminance, suppresses the increase in the power consumption, and achieves a PDP with a high-image-quality and a high luminance.

The half width value for Example 4 is smaller than Example 3 by 80 ns. This indicates that it is possible to increase the speed of the driving pulse.

The reason for the above is considered to be as follows. Compared with the case where the gaps between the electrodes are even, in the present case where the gap between the line electrodes becomes smaller as it goes away from the main discharge gap, the distribution of the electric field intensity expands toward outside the cell, which facilitates the expansion of the plasma, which grows by the discharge, toward outside the cell.

The number of peaks in the discharge current of the above PDP was measured for various values of (a) a difference between the average electrode gap "Save" and the main discharge gap G and (b) the electrode gap difference ΔS.

Figure 26:
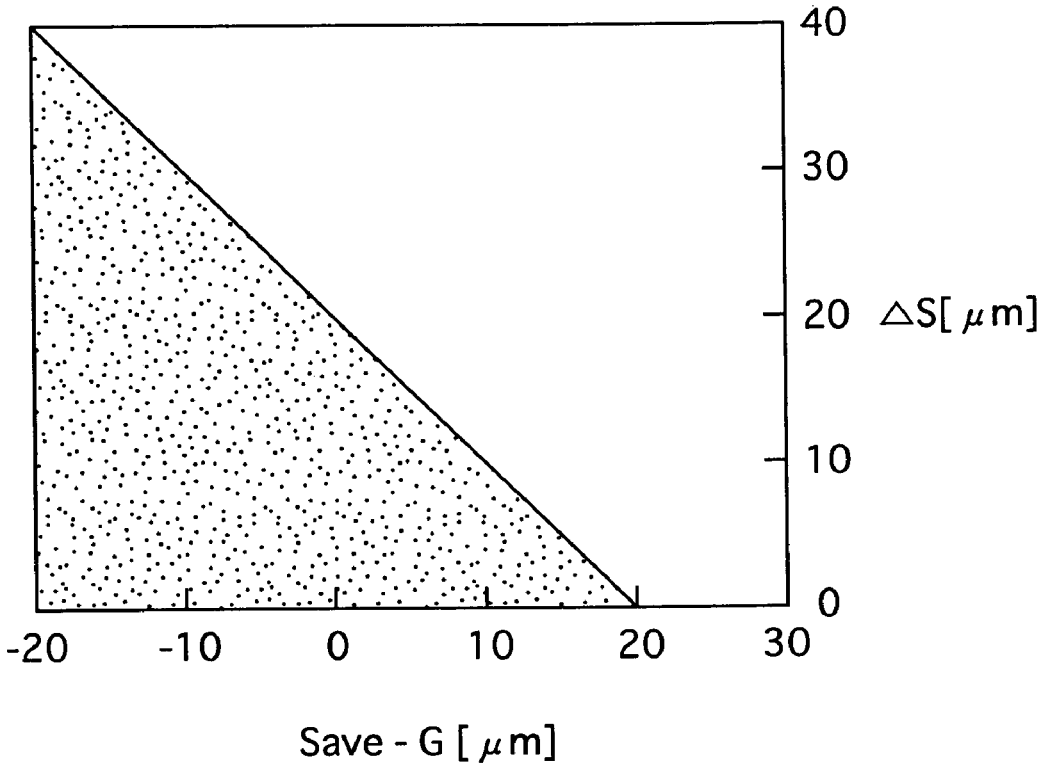
FIG. 26 shows (a) a difference between the average electrode gap "Save" and the main discharge gap G and (b) relationships between the electrode gap difference ΔS and the number of peaks in the discharge current.

FIG. 26 shows the measurement results. In FIG. 26, the half-tone dot area indicates that the discharge current had two or more discharge peaks, and the white area indicates that the discharge current had a single peak.

It is understood from FIG. 26 that as the difference between the average electrode gap "Save" and the main discharge gap G becomes larger, and as the electrode gap difference ΔS becomes larger, the discharge current is more apt to have a single peak.

It is also understood from FIG. 26 that, for example, even if the first electrode gap S1 is set to a value that is larger than the main discharge gap G by approximately 10 μm, the discharge current has a single peak if the average electrode gap "Save" is set to be smaller than the main discharge gap G and the electrode gap difference ΔS is set to be no smaller than 10 μm.

The reason why the discharge current has a single peak in the above case is considered to be as follows. Firstly, since the first electrode gap is adjacent to the main discharge gap, the discharge plasma expands well even if the first electrode gap is slightly larger than the main discharge gap. Secondly, since the gap between the line electrodes becomes smaller as it goes away from the main discharge gap, the continuity of the distribution of the electric field intensity in the discharge cell improves, and the electric field expands to the outermost electrode, facilitating the expansion of the discharge plasma to the outermost electrode, and allowing the discharge to continue as much.

Also, the dimension of the discharge cells is not limited to the above typical one, but may be varied to satisfy the following conditions to obtain the same effects: 0.5 mm≦P≦1.4 mm; 60 μm≦G≦140 μm; 10 μm≦L1, L2≦60 μm; 20 μm≦L3≦70 μm; 20 μm≦L4≦80 μm; 50 μm≦S1≦150 μm; 40 μm≦S2≦140 μm; and 30 μm≦S3≦130 μm.

Also, in Example 4, the width of line electrode is set to increase as it goes away from the main discharge gap. However, the same effects are obtained if the line electrode pitch is set to decrease as the line electrode goes away from the main discharge gap, with the width of the line electrode being fixed.

EXAMPLE 5

Figure 27:
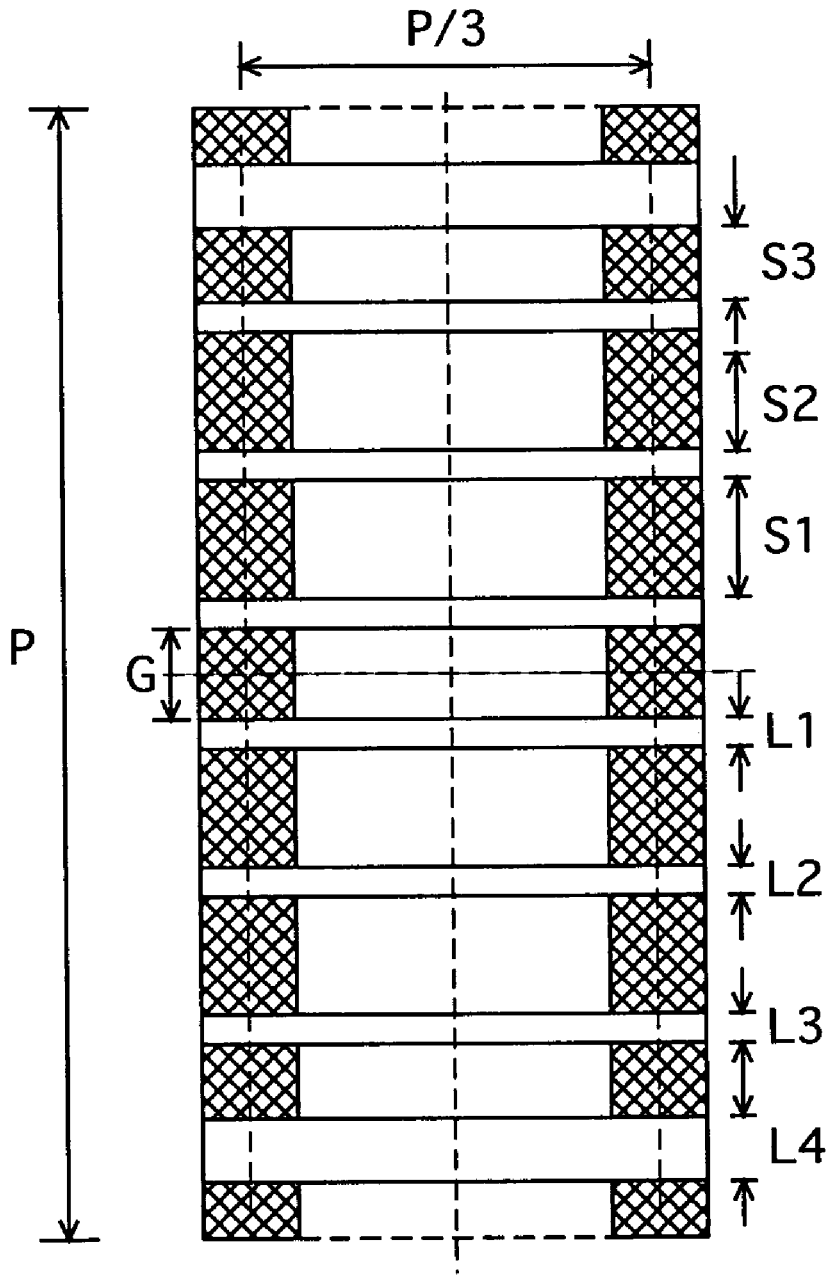
FIG. 27 shows an electrode pattern of Example 5.

FIG. 27 shows an electrode pattern of Example 5.

Example 5 is a PDP in which the gap between the line electrodes is set to decrease geometrically as it goes away from the main discharge gap toward the outermost line electrode, suppressing the average electrode gap to be no greater than the discharge gap, and at the same time increasing the equivalent electrode width.

With such a construction, it is possible to improve the effect of extracting the visible light by widening the main discharge gap in the center of the cell, and to expand the discharge plasma to the outermost sustain electrode by increasing the electric field intensity at the outermost electrodes.

In Example 5, a black layer is formed as a lower layer of the scanning electrode 19*a* and sustain electrode 19*b* so that a surface of the electrode group on the display side is black, where the black layer contains a black material such as ruthenium oxide.

A typical dimension of the discharge cell is as follows: the pixel pitch P=1.08 mm; the main discharge gap G=80 μm; electrode width (L1, L2)=35 μm; L3=45 μm; L4=85 μm; the first electrode gap S1=90 μm; the second electrode gap S2=60 μm; and the third electrode gap S3=40 μm.

Also, as is the case with Example 1, in Example 5, a sustain pulse having two rise steps is used when the PDP is driven.

Figure 28A:
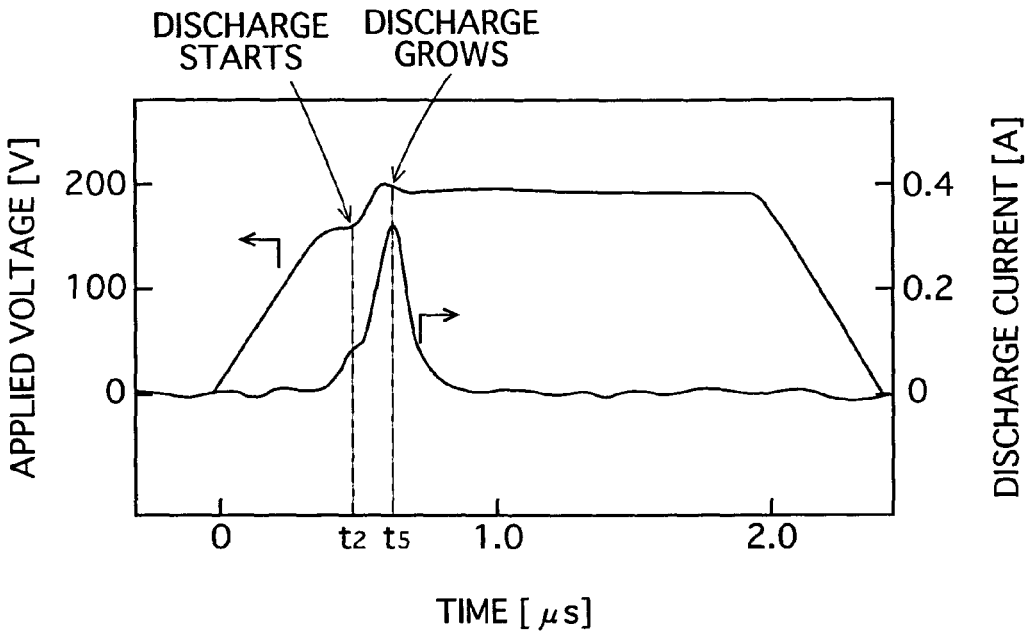
FIGS. 28A and 28B show waveforms of the sustain pulse and the discharge current in Example 5 and a comparative example.
Figure 28B:
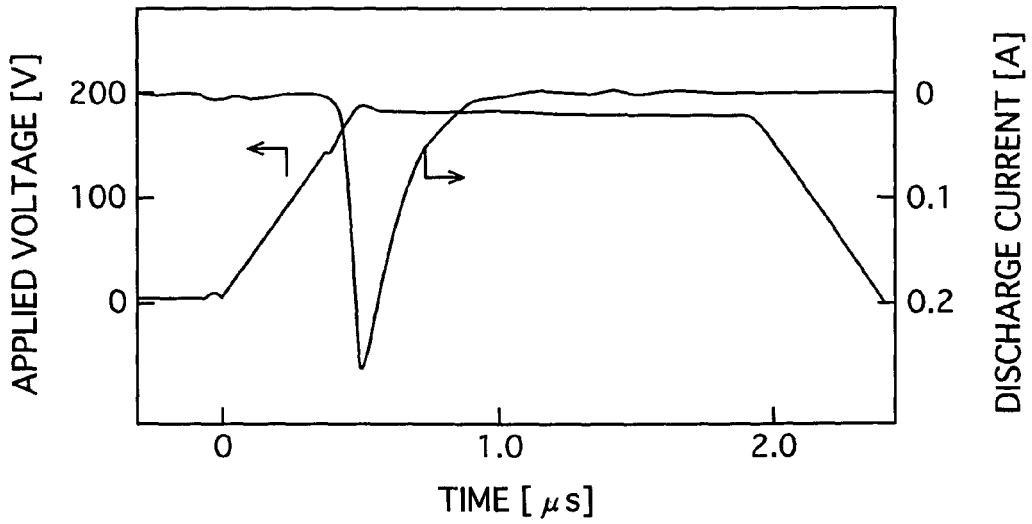

FIG. 28A shows the waveform of the sustain pulse and the waveform of the discharge current that is generated when the sustain pulse is applied. As shown in FIG. 28A, the rise start point t2 of the second step precedes the point t5 at which the discharge current is at the maximum. FIG. 28B shows the sustain pulse waveform and a typical discharge light-emission waveform of a comparative example which is a PDP having the same construction as Example 5 but is different in that the sustain pulse has a simple rectangular waveform.

The discharge light-emission waveform was measured by causing only one cell in the PDP to emit light, extracting the light emitted from the cell via optical fiber and an avalanche photodiode, and observing the light together with the driving voltage waveform using a digital oscilloscope. The light-emission peak waveform is an average of values obtained by integrating on the digital oscilloscope 1,000 times.

As shown in FIG. 28B: the discharge current waveform has a single peak; the discharge light emission ends within 1.0 μs since the start of the pulse application; the half width value is approximately 200 ns indicating a very draft change; the discharge delay is as short as approximately 0.5–0.6 μs; and the variation of the discharge delay has decreased. This indicates that a high-speed driving is possible with a pulse width of approximately 1.25 μs.

The reasons why the PDP, in which the gap between electrodes decreases geometrically as it goes away from the center of the discharge cell toward outside, enabled the discharge formation delay and statistics delay to reduce and enabled the variation of the half width value of the discharge light-emission peak and the discharge delay to decrease are considered to be as follows: the electric field intensity increased in the vicinity of the outermost electrodes and the discharge ended quickly.

In FIG. 28A, compared with FIG. 28B, the discharge current rises to a high level through two steps with sharp inclinations. This indicates that speeding up of the driving pulse is possible. Also, the discharge current immediately after the discharge start is suppressed to ⅓ the discharge current at the maximum. This indicates that a greater part of the power from the driving circuit is used by the discharge cells when the discharge current grows.

It was also found through another experiment that the discharge current peak width in driving the PDP of Example 5 is approximately 200 ns smaller than in driving a PDP in which four line electrodes are arranged with even gaps in between.

Then, Example 5, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 5 shows the comparison results.

TABLE 5

| | Relative luminance B | Relative power consumption W | Relative luminous efficiency η |
|---|---|---|---|
| Simple rectangular wave | 1.00 | 1.00 | 1.00 |
| Waveform of Example 5 | 1.72 | 1.45 | 1.19 |

As shown in Table 5, Example 5's waveform is approximately 1.72 times the comparative example in the luminance, but compared to this, the increase in power consumption is relatively small, and Example 5's waveform also increases the light emission efficiency by approximately 20%.

This indicates that using a staircase waveform having two rise steps for the sustain pulse, as in Example 5, greatly increases the luminance, suppresses the increase in the power consumption, and achieves a PDP with a high-image-quality and a high luminance.

Advantageous Effects of Black Layer

The daylight contrast was measured for the PDP of Example 5 by varying the blackness ratio in relation to the width of an outermost electrode, where the blackness ratio is obtained by dividing the discharge cell area by the shielding area and is represented as "2(L1+L2+L3+L4)/P". Note that the shielding area is the area of the discharge cell where the light is shielded by electrodes.

Figure 29:
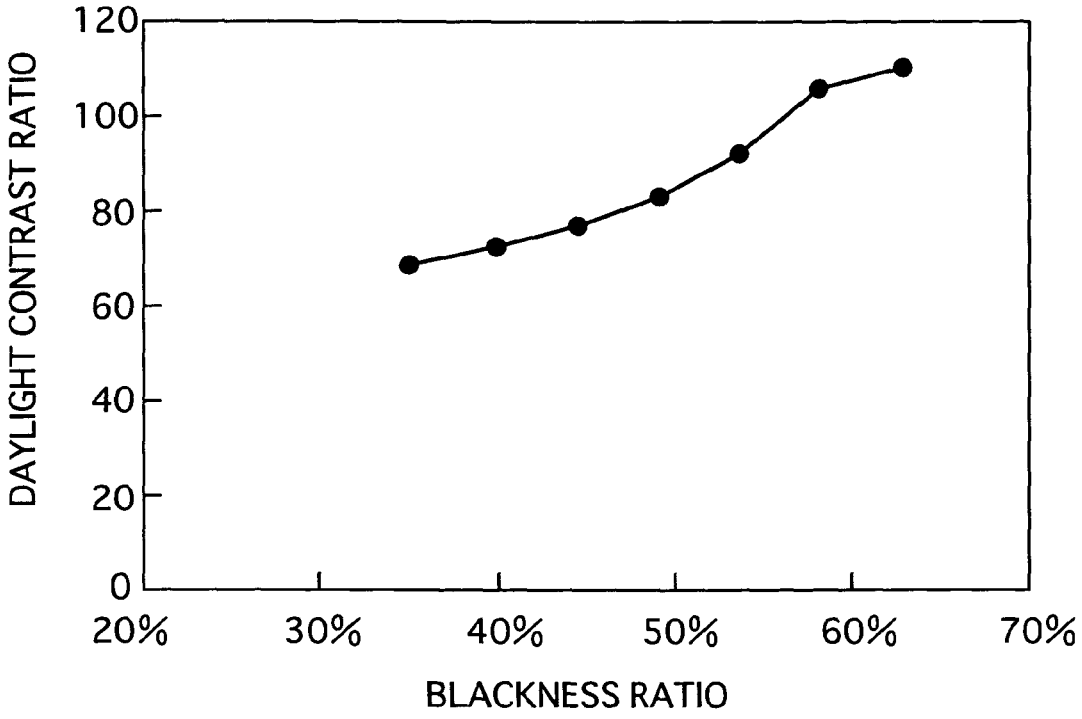
FIG. 29 shows relationships between the blackness ratio and the daylight contrast in relation to the width of an outermost electrode in the PDP of Example 5.

FIG. 29 shows the measurement results and is a graph showing the relationships between the blackness ratio and the daylight contrast.

The daylight contrast value obtained here is a ratio of the luminance measured in white display to that in black display when the vertical and horizontal illuminance at the display surface of the PDP were 70 Lx and 150 Lx, respectively.

In conventional PDPs that generally use white materials in the phosphor layers and stripe ribs, the contrast ratio in the daylight was approximately in the range of 20:1 to 50:1 due to a large reflection of outside light on the panel display.

In contrast, in the PDP of Example 5, as shown in FIG. 29, the contrast ratio in the daylight is as high as no lower than 70:1.

As described above, the PDP of Example 5 provides a high daylight contrast and a high luminance. The reason for this is considered to be as follows: the PDP has succeeded to increase the blackness ratio without reducing the main discharge gap area at the center of the cell by increasing the width of the outermost electrodes, setting the width of inner electrodes in the cell to be narrow, and making the surface of the electrodes on the display side black.

Regarding FIG. 29, it is expected that if the blackness ratio is increased by increasing the width of the outermost electrodes, the daylight contrast is also increased. However, the daylight contrast is apt to be saturated. Also, if the blackness ratio is increased, the luminance further reduces due to reduction in a ratio of the area of gaps between electrodes to the area of electrodes. When the blackness ratio is 50%, the luminance reduces by approximately 10%; and when the blackness ratio is 60%, the luminance reduces by approximately 20%. Accordingly, it is desirable that the blackness ratio is approximately 60% at the maximum.

There is known a technique for forming black stripes in PDP to improve the contrast. The technique has a problem that the yields decrease due to a failure in alignment of the black stripes and the sustain electrodes when the electrodes are formed.

In the case of Example 5 in which the black layer is formed on the electrodes, the contrast is improved as described above, and there is no need of using the black stripes. This simplifies the manufacturing process and enables a high-contrast PDP to be manufactured at a low cost.

Also note that the discharge current waveform and the light emission waveform had a single peak regardless of the electrode construction.

As described above, when a sustain pulse having a staircase waveform is used in the PDP in which the display-side surfaces of the scanning and sustain electrodes having the split electrode structure are black, the PDP has higher luminance and luminous efficiency than conventional ones, and provides a high daylight contrast and a high-speed driving even though the black stripes are not used in the cell structure.

In Example 5, the electrode structure has four line electrodes. However, similar effects are obtained if an electrode structure having five line electrodes is adopted.

Also, the dimension of the discharge cells is not limited to the above typical one, but may be varied to satisfy the following conditions to obtain the same effects: 0.5 mm≦P≦1.4 mm; 70 μm≦G≦120 μm; 10 μm≦L1, L2≦50 μm; 20 μm≦L3≦60 μm; 40 μm≦L4≦[0.3P−(L1+L2+L3)] μm; 50 μm≦S1≦150 μm; 40 μm≦S2≦140 μm; and 30 μm≦S3≦130 μm.

EXAMPLE 6

Figure 30:
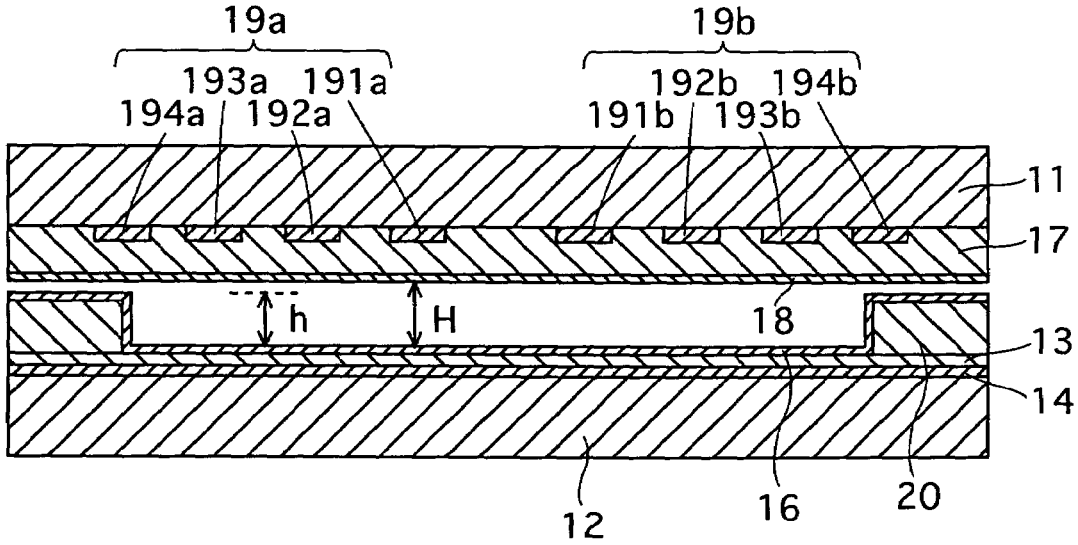
FIG. 30 shows a discharge cell structure of the PDP of Example 6.

FIG. 30 shows a discharge cell structure of a PDP of Example 6. Example 6 ahs the same electrode structure as Example 5. The scanning electrode 19*a* has four line electrodes 191*a*–194*a*, and the sustain electrode 19*b* has four line electrodes 191*b*–194*b*. Also, the gap between the line electrodes is set to decrease geometrically as it goes away from the main discharge gap. However, Example 6 differs from Example 5 in that auxiliary ribs 20 that are no greater than the stripe ribs 15 in height are formed between adjacent discharge cells.

A typical dimension of the discharge cell is as follows: the pixel pitch P=1.08 mm; the main discharge gap G=80 μm; electrode width (L1, L2)=35 μm; L3=45 μm; L4=85 μm; the first electrode gap S1=90 μm; the second electrode gap S2=60 μm; the third electrode gap S3=40 μm; a short bar line width Wsb=40 μm; a stripe rib height H=110 μm; an auxiliary rib height h=60 μm; an auxiliary rib top width "walt"=60 μm; and an auxiliary rib bottom width "walb"=100 μm.

Also, as is the case with Example 1, in Example 6, a sustain pulse having two rise steps is used when the PDP is driven.

Figure 31:
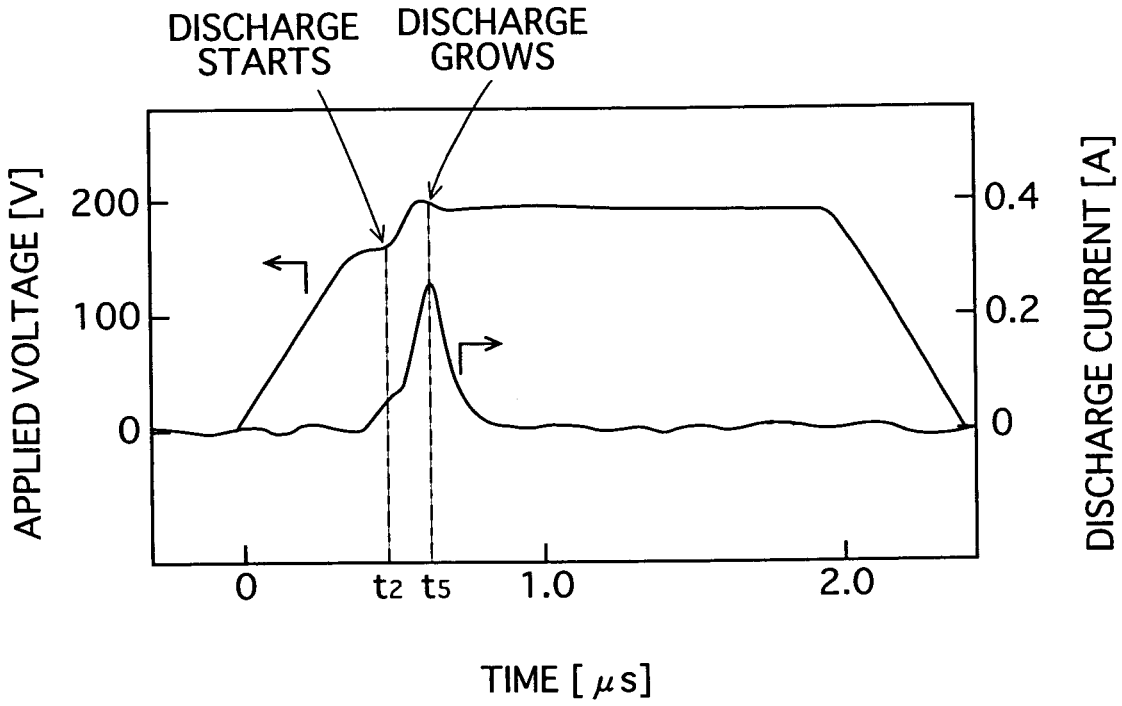
FIG. 31 shows waveforms of the sustain pulse and the discharge current in Example 6.

FIG. 31 shows the waveform of the sustain pulse and the waveform of the discharge current that is generated when the sustain pulse is applied, and shows similar characteristics as FIG. 28A.

It should be noted here that when a case (A) in which a sustain pulse has the staircase waveform was compared with a case (B) in which a sustain pulse has a simple rectangular waveform, it was found that the case (A) has the luminance of approximately 1.7 times that of the case (B), but compared to this, the increase in power consumption is relatively small, and the case (A) also increases the light emission efficiency by approximately 20%.

An experiment was conducted on a PDP of Example 6 to check whether an erroneous discharge occurs due to a crosstalk, for each of the cases where the auxiliary ribs are formed and not formed, combined with various values of an inter-cell distance "Ipg" (a distance between an outermost line electrode 194*a* and a line electrode 194*b* that is in a discharge cell adjacent to a discharge cell including the outermost line electrode 194*a*).

TABLE 6

| Ipg[μm] | 60 | 120 | 260 | 260 | 300 | 300 | 360 | 360 |
|---|---|---|---|---|---|---|---|---|
| Auxiliary ribs | Yes | Yes | No | Yes | No | Yes | No | Yes |
| Crosstalk/ Erroneous Discharge | X | ○ | X | ○ | X | ○ | ○ | ○ |

Table 6 shows the results of this experiment. The sign "○" indicates that no erroneous discharge due to a crosstalk occurred; and the sign "X" indicates that such an erroneous discharge occurred.

The results shown in Table 6 indicate that in a PDP that does not have auxiliary ribs, such an erroneous discharge occurs if the inter-cell distance Ipg is no greater than approximately 300 μm. It should be noted here that a flickering or a grainy screen in the gray level was observed in the PDPs in which the erroneous discharge occurred.

On the other hand, the experiment results indicate that in a PDP that has auxiliary ribs as in Example 6, such an erroneous discharge does not occur if the inter-cell distance Ipg is no greater than approximately 120 μm, and the image quality is excellent.

The reason why the erroneous discharge is restricted by the auxiliary ribs is that the auxiliary ribs prevent (a) priming particles such as charge particles and (b) resonance lines in a vacuum ultraviolet region that are generated by the discharge plasma in a discharge cell from diffusing into adjacent cells.

Meanwhile, as the auxiliary ribs are greater in height, the effect of restricting the crosstalk increases. However, when, during a bonding/evacuation process in manufacturing of a PDP, an inner space of panels is evacuated at a high temperature before a discharge gas is enclosed therein, high auxiliary ribs reduce the conductance in the panels. This leads to decrease in the degree of vacuum. When this happens, the discharge gas is enclosed while residual gases such as $H_2O$ or $CO_2$ are adsorbed on the inner surface of the panels. The residual gases then turn into impurity gas elements that become main contributors to a shifted operation point at the driving or to an erroneous discharge.

Meanwhile, auxiliary ribs as high as approximately 60 μm are enough to gain the effect of restricting crosstalk. It is therefore preferable that the auxiliary ribs are at least 10 μm lower than the stripe ribs.

It was further found from a study for various values of the auxiliary rib top width "walt" that it is possible to restrict, independently of the electrode structure, the discharge plasma generation area in the discharge cells by increasing the auxiliary rib top width "walt". This indicates that the power to be supplied to the PDP can be controlled independently of the electrode structure in the front panel.

When auxiliary ribs are not formed, the inter-cell distance should be as large as approximately 120 μm to restrict the crosstalk. However, when auxiliary ribs are formed and the auxiliary rib top width "walt" is widened to approximately 180 μm, the inter-cell distance "Ipg" can be as small as approximately 60 μm to avoid the crosstalk, restrict the increase in the sustain power, and obtain a relatively high efficiency and an excellent image quality.

As described above, Example 6 provides a low-power-consumption, high-image-quality PDP in which the problem of the erroneous discharge occurring in adjacent cells due to crosstalk has been substantially solved.

Also, the dimension of the discharge cells is not limited to the above typical one, but may be varied to satisfy the following conditions to obtain the same effects: 0.5 mm≦P≦1.4 mm; 60 μm≦G≦140 μm; 10 μm≦L1, L2≦60 μm; 20 μm≦L3≦70 μm; 20 μm≦L4≦[0.3P−(L1+L2+L3)] μm; 50 μm≦S1≦150 μm; 40 μm≦S2≦140 μm; 30 μm≦S3≦130 μm; 10 μm≦Wsb≦80 μm; 50 μm≦walt≦450 μm; and 60 μm≦h≦H−10 μm.

In Example 6, auxiliary ribs are formed in a PDP having the electrode construction of Example 5. However, the same effect for preventing crosstalk is obtained when auxiliary ribs are formed in a PDP having the electrode construction of Example 1, 2, 3 or 4.

EXAMPLE 7

Example 7 is a PDP in which the scanning and sustain electrodes have the non-split electrode structure. Example 7 has a driving waveform shown in the timing chart of FIG. 4. The sustain pulse has a waveform that rises in two steps and falls in two steps.

Figure 32:
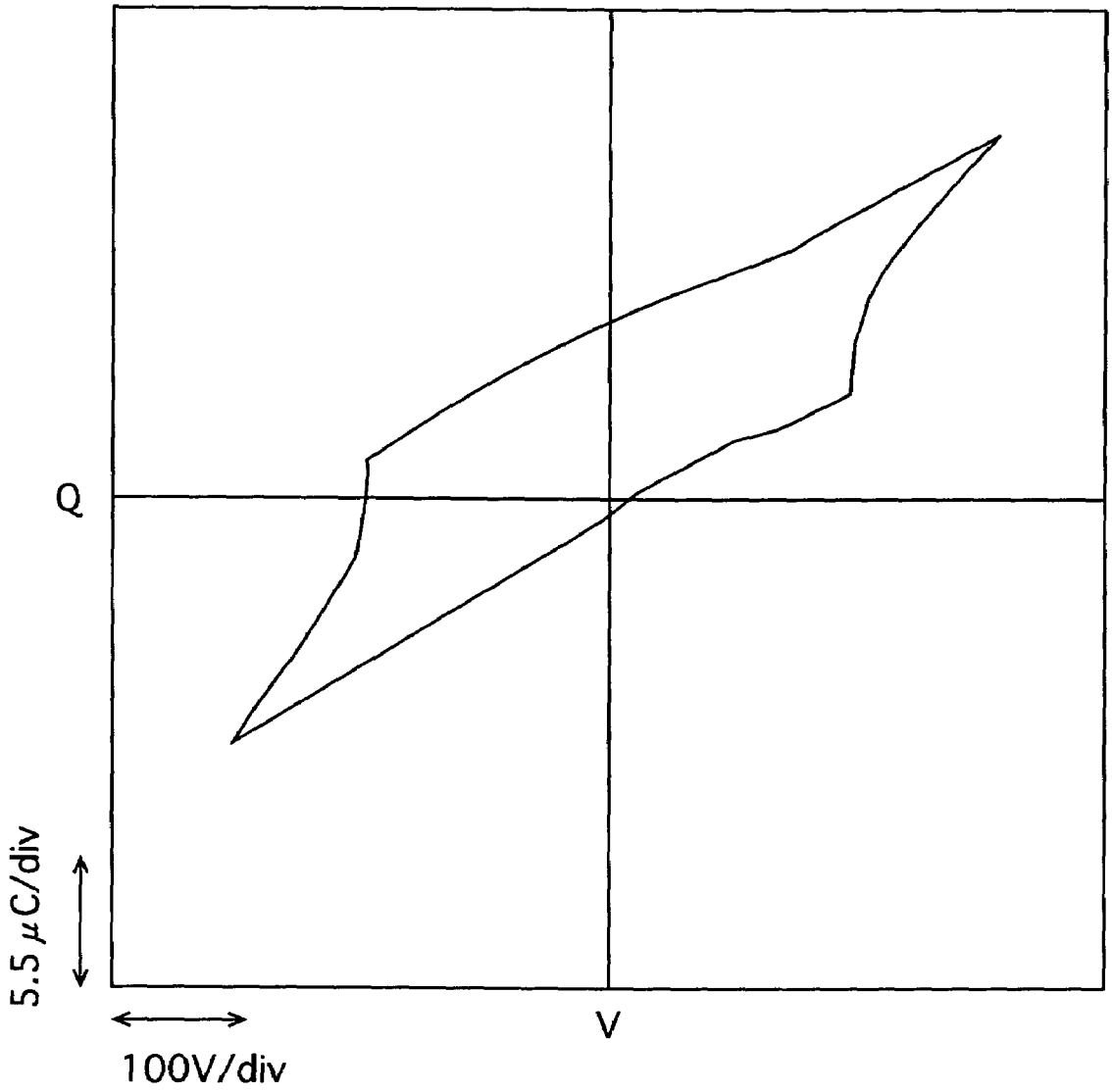
FIG. 32 is a V-Q Lissajous's figure of Example 7.

FIG. 32 is a V-Q Lissajous's figure of Example 7. The loop in FIG. 32 is a distorted parallelogram. Also, as is the case with Example 1, a similarly distorted parallelogram was obtained as the loop of the V-Q Lissajous's figure when the voltage V1 for the first period was varied within a range satisfying "Vf−20V≦V1≦Vf+30V", where Vf represents a discharge start voltage Vf, and the time period between the rise start point t1 of the first step and the rise start point t2 of the second step was varied within a range of (discharge delay time Tdf−0.2 μsec) to (Tdf+0.2 μsec) inclusive.

Then, Example 7, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 7 shows the comparison results.

TABLE 7

| | Relative luminance B | Relative power consumption W | Relative luminous efficiency η |
|---|---|---|---|
| Simple rectangular wave | 1.00 | 1.00 | 1.00 |
| Waveform of Example 7 | 1.81 | 1.50 | 1.21 |

As shown in Table 7, Example 7's waveform is approximately 1.8 times the comparative example in the luminance, but compared to this, the increase in power consumption is restricted to being 1.5 times the comparative example, and Example 7's waveform also increases the light emission efficiency by approximately 21%.

This indicates that by using a staircase waveform having two-case rise and fall for the sustain pulse, it is possible to greatly increase the luminance while suppressing the increase in the power consumption, and therefore to achieve a PDP with a high-image-quality and a high luminance.

EXAMPLE 8

Example 8 is a PDP in which the scanning and sustain electrodes have the non-split electrode structure.

In Example 8, as is the case with Example 7, the sustain pulse has a waveform that rises in two steps and falls in two steps. The following describes the details of the settings in Example 8.

Figure 33:
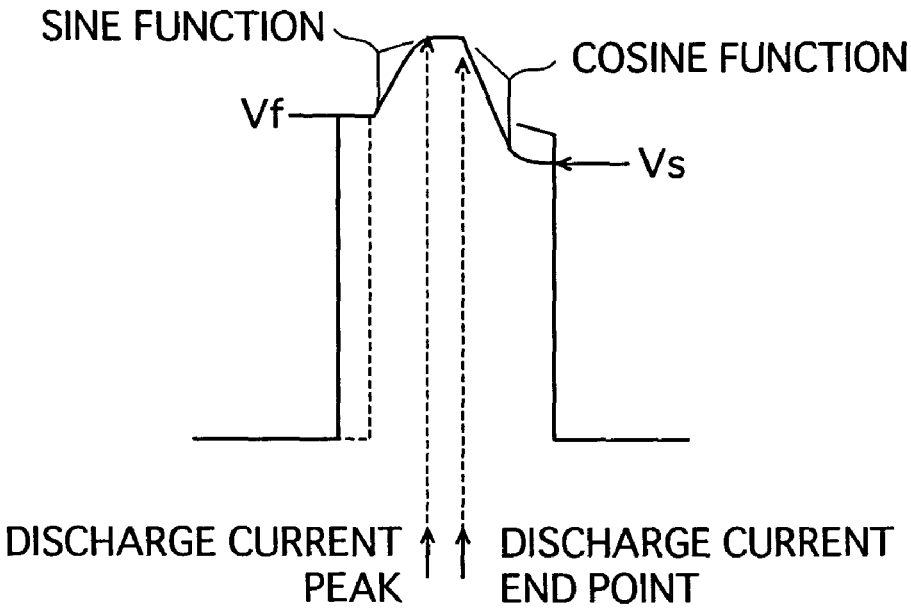
FIG. 33 shows a sustain pulse waveform of Example 8.

FIG. 33 shows a sustain pulse waveform of Example 8.

In the sustain pulse of Example 8, the voltage in the first step of rise is set to the discharge start voltage Vf, then the voltage rises from the first step to the second step with an inclination which is observed as a sine function so that the largest inclination corresponds to the maximum point of the discharge current. Then as the discharge ends, the voltage falls to the smallest discharge voltage Vs with an inclination which is observed as a cosine function. It should be noted here that the smallest discharge voltage Vs is measured as follows: a voltage is applied to between a scanning electrode 19*a* and a sustain electrode 19*b* of a PDP to cause a discharge cell to emit light; the applied voltage is decreased gradually; and the applied voltage is read as the smallest discharge voltage Vs when the discharge cell begins to stop emitting light.

As described above, when a waveform, in which a voltage falls to the smallest discharge voltage with an inclination which is observed as a trigonometric function, is used, an amount of invalid power among the recovered power is reduced. This reduces the amount of power a PDP display apparatus consumes. Also, occurrence of a harmonic noise is suppressed, and therefore the electromagnetic interference (EMI) is suppressed.

Figure 34:
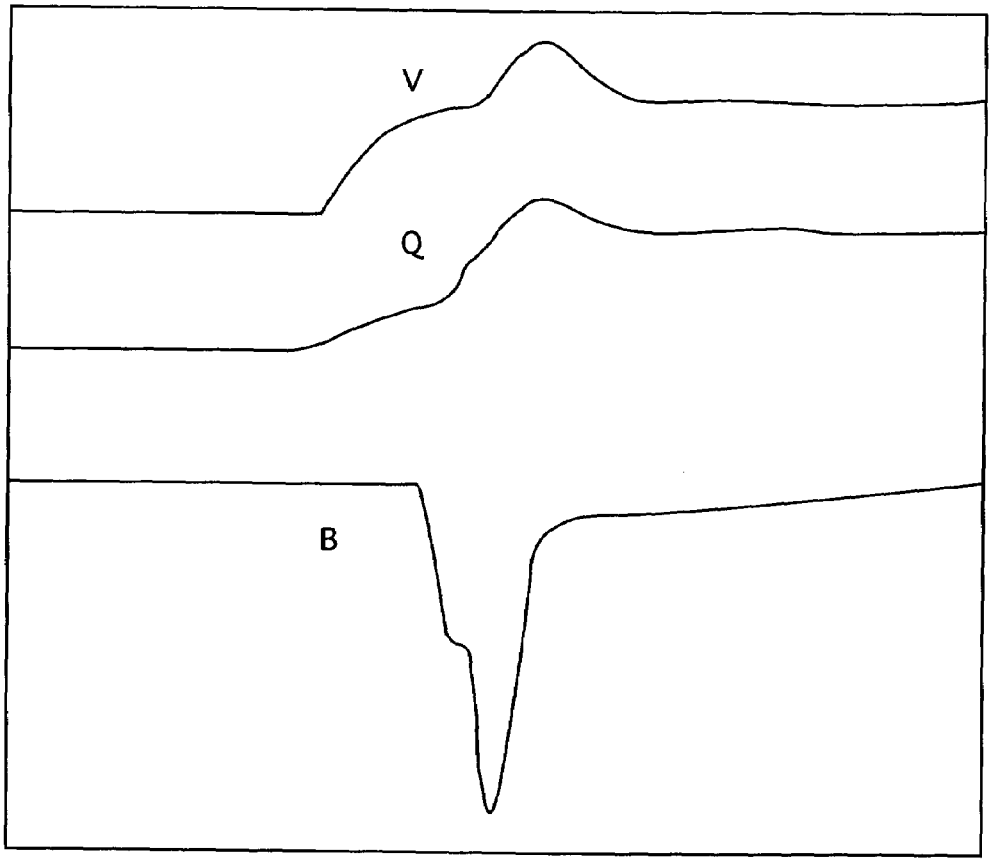
FIG. 34 shows a voltage V between electrodes, an amount Q of charges accumulated in the discharge cells, and an amount B of light emission in the PDP of Example 8.

FIG. 34 shows change in properties of Example 8 PDP with time, where "V" represents a voltage between electrodes in discharge cells, "Q" an amount of charges accumulated in the discharge cells, and "B" an amount of light emission.

FIG. 34 indicates that after the voltage pulse rises to the discharge start voltage, first the discharge current starts to flow, then the voltage starts to rise in the second step (in terms of the phase, the voltage rise in the second step is later than the rise of the discharge current), and when the discharge current is at its peak, the voltage rise has the largest inclination. The reason for this is considered to be that the sustain pulse rises with two steps and falls with two steps, causing the voltage change between the first and second steps to be observed as a trigonometric function. FIG. 34 also indicates that a high voltage is applied to the discharge cells only when light is emitted by discharge. The reason for this is considered to be that the voltage falls to the smallest discharge voltage Vs as the discharge current stops to flow.

Figure 35:
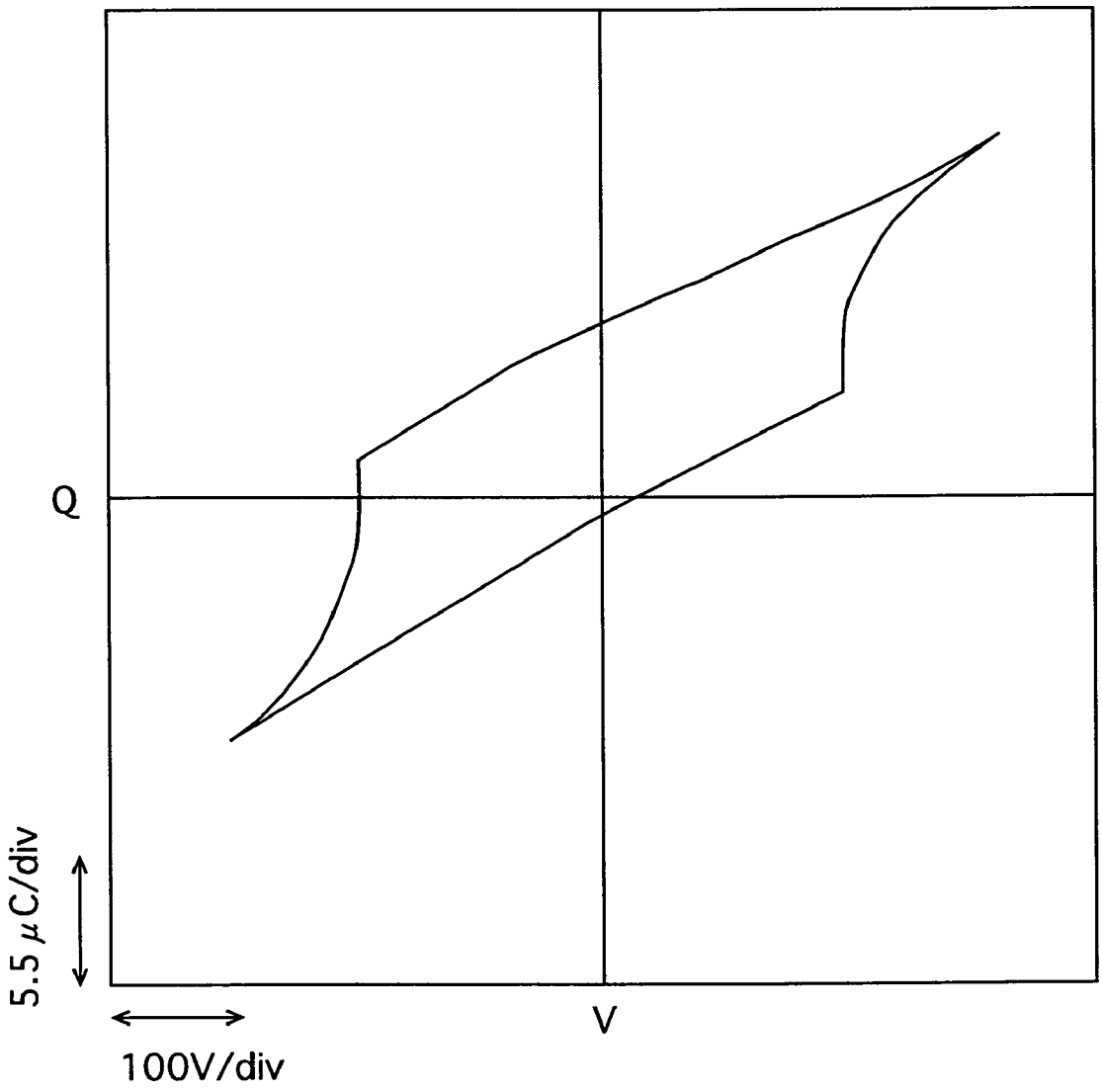
FIG. 35 is a V-Q Lissajous's figure of Example 8.

FIG. 35 is a V-Q Lissajous's figure of Example 8. The loop in FIG. 35 is a distorted parallelogram. The loop has inwardly arc-shaped sides.

FIG. 35 indicates that the power is supplied to the plasma in the discharge cells effectively. It is understood from this that by allowing the phase of the voltage change between the first and second steps to be behind the phase of the discharge current, it is possible to keep the PDP in a state where it receives an application of an over voltage from the power source, even after the discharge starts in the cells.

Then, Example 8, in which the waveform of the present embodiments is used in the sustain pulse, was compared with the comparative example, in which a simple rectangular waveform is used in the sustain pulse, in terms of the relative luminance, the relative power consumption, and the relative luminous efficiency. Table 8 shows the comparison results.

TABLE 8

| | Relative luminance B | Relative power consumption W | Relative luminous efficiency η |
|---|---|---|---|
| Simple rectangular wave | 1.00 | 1.00 | 1.00 |
| Waveform of Example 8 | 2.11 | 1.62 | 1.30 |

As shown in Table 8, Example 8's waveform is more than 2 times the comparative example in the luminance, but compared to this, the increase in power consumption is relatively small, and Example 8's waveform also increases the light emission efficiency by approximately 30%.

This indicates that Example 8 greatly increases the luminance while suppressing the increase in the power consumption, and therefore achieves a PDP with a high-image-quality and a high luminance.

In Example 8, a trigonometric function is used for the rise in the second step. However, off course, another continuous function such as an exponential function or a Gaussian distribution function may be used to obtain the same effects.

INDUSTRIAL APPLICABILITY

The PDP apparatus and the driving method thereof of the present invention provides advantageous effects as a display apparatus for use in a computer or a television.

The invention claimed is:

1. A plasma display apparatus comprising:

a plasma display panel including a pair of substrates between which a pair of electrodes are formed, a plurality of discharge cells being formed along the pair of electrodes; and a driving circuit that drives the plasma display panel by selectively writing information onto the plurality of discharge cells, then causing cells, on which the information is written, to emit light by applying a sustain pulse to the pair of electrodes, wherein the sustain pulse applied by the driving circuit has (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion, and the second waveform portion starts before a discharge delay time elapses since a start of the first waveform portion.

2. The plasma display apparatus of claim 1, wherein the sustain pulse forms a staircase waveform by a voltage change between the first waveform portion and the second waveform portion.

3. The plasma display apparatus of claim 1, wherein the sustain pulse forms an inclination as a voltage at a start point of the second waveform portion changes to the second voltage.

4. The plasma display apparatus of claim 3, wherein an inclination formed in correspondence with a change between a voltage at a start point of the first waveform portion and the first voltage is different from the inclination formed in correspondence with the change between the voltage at the start point of the second waveform portion and the second voltage.

5. The plasma display apparatus of claim 1, wherein a change between a voltage at a start point of the second waveform portion and the second voltage is observed as a continuous function.

6. The plasma display apparatus of claim 1, wherein the absolute value of the first voltage ranges from "Vf−20V" to "Vf+20V" inclusive, wherein Vf represents the discharge start voltage.

7. The plasma display apparatus of claim 1, wherein the absolute value of the first voltage ranges from 100V to 200V inclusive.

8. The plasma display apparatus of claim 1, wherein the absolute value of the second voltage ranges from "V1+10V" to 2V1 inclusive, wherein V1 represents the absolute value of the first voltage.

9. The plasma display apparatus of claim 1, wherein the absolute value of the second voltage ranges from Vf to "Vf+150V" inclusive, wherein Vf represents the discharge start voltage.

10. The plasma display apparatus of claim 1, wherein the sustain pulse has a third waveform portion where a third voltage, an absolute value of which is smaller than the absolute value of the second voltage, is applied, the third waveform portion following the second waveform portion.

11. The plasma display apparatus of claim 10, wherein the absolute value of the third voltage is smaller than to absolute value of the first voltage.

12. The plasma display apparatus of claim 10, wherein the absolute value of the third voltage is no greater than the discharge start voltage.

13. The plasma display apparatus of claim 10, wherein the absolute value of the second voltage ranges from "V1−100V" to "V1−10V" inclusive, wherein V1 represents the absolute value of the first voltage.

14. The plasma display apparatus of claim 10, wherein a voltage fall from a start point of the third waveform portion to a smallest discharge voltage is observed as a trigonometric function.

15. The plasma display apparatus of claim 10, wherein a voltage change within a discharge time in the third waveform portion until a discharge current ends is observed as a trigonometric function.

16. The plasma display apparatus of claim 1, wherein the electrodes in the pair are ranged in parallel with each other, and a projection, which projects from each of the electrodes toward the other, is formed for each discharge cell.

17. The plasma display apparatus of claim 16, wherein each projection is wider at a tip thereof than at a basal portion thereof.

18. The plasma display apparatus of claim 16, wherein the electrodes in the pair are arranged in parallel with each other, and a plurality of line-shaped projections further extend from each projection along the electrodes in each discharge space.

19. A plasma display apparatus comprising;

a plasma display including a pair of substrates between which a pair of electrodes are formed in parallel with each other, with a plurality of discharge cells formed along the pair of electrodes; and a driving circuit that drives the plasma display by selectively writing information onto the plurality of discharge cells, then causing cells, on which the information is written, to emit light by applying a sustain pulse to the pair of electrodes, wherein each of the electrodes is, in each discharge space, divided into a plurality of line electrodes that extend along the electrodes, the sustain pulse applied by the driving circuit has (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion, and the second waveform portion starts before a discharge delay time elapses since a start of the first waveform portion.

20. The plasma display apparatus of claim 19, wherein sub-electrodes are formed on line electrodes in each discharge cell on a one-to-one basis, and sub-electrodes closer to a main gap between the electrodes are longer than sub-electrodes closer to outside.

21. The plasma display apparatus of claim 19, wherein each of the electrodes is, in each discharge space, divided into four or ore line electrodes, and a gap between line electrodes closer to outside is narrower than a gap between line electrodes closer to a main gap between the electrodes.

22. The plasma display apparatus of claim 19, wherein the sustain pulse has a third waveform portion where a third voltage, an absolute value of which is smaller than the absolute value of the second voltage, is applied, the third waveform portion following the second waveform portion.

23. The plasma display apparatus of claim 22, wherein the absolute value of the third voltage is smaller than the absolute value of the first voltage.

24. The plasma display apparatus of claim 19, wherein an average value of a distance between line electrodes of the plurality of line electrodes ranges from "G−60 μm" to "G+20 μm" inclusive, wherein G represents width of a main gap between the electrodes.

25. The plasma display apparatus of claim 19, wherein width of each line electrode ranges from 5 μm to 120 μm inclusive.

26. The plasma display apparatus of claim 19, wherein a condition "$Lave<Ln \leqq [0.35P-(L1+L2+ \ldots +Ln-1)]$" is satisfied, wherein "P" represents a cell pitch in a direction perpendicular to the electrodes, each electrode in the pair is divided into n line electrodes, "Lave" represents an average electrode width of the line electrodes, and "Lk" represents a width of a $k^{th}$ line electrode when counted from a main gap between the electrodes.

27. The plasma display apparatus of claim 19, wherein a condition "$0.5Lave<L1, L2 \leqq Lave$" is satisfied, wherein "P" represents a cell pitch in a direction perpendicular to the electrodes, "Lave" represents an average electrode width of to line electrodes, and "L1" and "L2" respectively represent electrode widths of the first and the second line electrodes when counted from a main gap between the electrodes.

28. The plasma display apparatus of claim 19, wherein (i) main stripe ribs that extend in one direction in stripes and (ii) auxiliary ribs that divide off spaces between the stripe ribs are formed between the pair of substrates.

29. The plasma display apparatus of claim 28, wherein the auxiliary ribs are formed on one of the substrates in the pair, and a width of the auxiliary ribs at a top thereof ranges from 30 μm to 600 μm inclusive.

30. The plasma display apparatus of claim 28, wherein a height of the auxiliary ribs ranges from 40 μm to a height of the main stripe ribs inclusive.

31. The plasma display apparatus of claim 19, wherein a half discharge peak width value in relation to a shape of a discharge light-emission peak ranges from 30 ns to 1.0 μs inclusive.

32. A driving method for driving a plasma display which includes a pair of substrates between which a pair of electrodes are formed, and has a plurality of discharge cells formed along the pair of electrodes, by selectively writing information onto the plurality of discharge cells, then causing cells, on which the information is written, to emit light by applying a sustain pulse to the pair of electrodes, wherein the sustain pulse applied by the driving circuit has (i) a first waveform portion where a first voltage, an absolute value of which is no smaller than a discharge start voltage, is applied and (ii) a second waveform portion where a second voltage, an absolute value of which is greater than the absolute value of the first voltage, is applied, the second waveform portion following the first waveform portion, and a start point of the second waveform portion is earlier than an end point of a discharge delay time that starts simultaneously with the first waveform portion.

33. The driving method of claim 32, wherein the sustain pulse forms a staircase waveform by a voltage change between the first waveform portion and the second waveform portion.

34. The driving method of claim 32, wherein the sustain pulse forms an inclination by a voltage change between a start point of the second waveform portion and a start of the second voltage.

35. The driving method of claim 34, wherein an inclination formed by a voltage change between a start point of the first waveform portion and a start of the first voltage is different from the inclination formed by the voltage change between the start point of the second waveform portion and the start of the second voltage.

36. The driving method of claim 32, wherein a voltage change between a start point of the second waveform portion and a start of the second voltage is observed as a continuous function.

37. The driving method of claim 32, wherein the absolute value of the first voltage ranges from "Vf−20V" to "Vf+30V" inclusive, wherein Vf represents the discharge start voltage.

38. The driving method of claim 32, wherein the absolute value of the first voltage ranges from 100V to 200V inclusive.

39. The driving method of claim 32, wherein the absolute value of the second voltage ranges from "V1+10V" to 2V1 inclusive, wherein V1 represents the absolute value of the first voltage.

40. The driving method of claim 32, wherein the absolute value of the second voltage ranges from Vf to "Vf+150V" inclusive, wherein Vf represents the discharge start voltage.

41. The driving method of claim 32, wherein the sustain pulse has a third waveform portion where a third voltage, an absolute value of which is smaller than the absolute value of the second voltage, is applied, the third waveform portion following the second waveform portion.

42. The driving method of claim 41, wherein the absolute value of the third voltage is smaller than the absolute value of the first voltage.

43. The driving method of claim 41, wherein the absolute value of the third voltage is no greater than the discharge start voltage.

44. The driving method of claim 41, wherein the absolute value of the second voltage ranges from "V1−100V" to "V1−10V" inclusive, wherein V1 represents the absolute value of the first voltage.

45. The driving method of claim 41, wherein a voltage fall from a start point of the third waveform portion to a smallest discharge voltage is observed as a trigonometric function.

46. The driving method of claim 41, wherein a voltage change within a discharge time in the third waveform portion until a discharge current ends is observed as a trigonometric function.

47. A driving method for driving a plasma display which includes a pair of substrates between which a pair of electrodes are formed in parallel with each other, and has a plurality of discharge cells formed along the pair of electrodes, by selectively writing information onto the plurality of discharge cells, then causing cells, on which the information is written, to emit light by applying a sustain pulse to the pair of electrodes, wherein each of the electrodes is, in each discharge space, divided into a plurality of line electrodes that extend along the electrodes, the sustain pulse applied by the driving circuit has (i) a first waveform portion where a first voltage, an absolute value of which is no smaller than a discharge start voltage, is applied and (ii) a second waveform portion where a second voltage, an absolute value of which is greater than the absolute value at the first voltage, is applied, the second waveform portion following the first waveform portion, and the second waveform portion starts before a discharge delay time elapses since a start of the first waveform portion.

48. The plasma display apparatus of claim 47, wherein a start point of the second waveform portion is earlier than an end point of a discharge delay time that starts simultaneously with the first waveform portion.

49. The plasma display apparatus of claim 47, wherein the pulse has a third waveform portion where a third voltage, an absolute value of which is smaller than the absolute value of the second voltage, is applied, the third waveform portion following the second waveform portion.

50. The plasma display apparatus of claim 49, wherein the absolute value of the third voltage is smaller than the absolute value of the first voltage.

* * * * *

UNITED STATES PATENT AND TRADEMARK OFFICE

CERTIFICATE OF CORRECTION

PATENT NO. : 7,068,244 B2
APPLICATION NO. : 10/398606
DATED : June 27, 2006
INVENTOR(S) : Nobuaki Nagao et al.

It is certified that error appears in the above-identified patent and that said Letters Patent is hereby corrected as shown below:

In the Claims:
In Claim 6, Column 32, line 9, “Vf+20V” should be --Vf+30V--.
In Claim 11, Column 32, line 29, “to” should be --the--.
In Claim 21, Column 33, line 24, “ore” should be --more--.

Signed and Sealed this

Twenty-fourth Day of July, 2007

JON W. DUDAS
*Director of the United States Patent and Trademark Office*